US012151182B2

(12) United States Patent
Chen

(10) Patent No.: US 12,151,182 B2
(45) **Date of Patent: *Nov. 26, 2024**

(54) MAGNETIC SUCTION BUILDING BLOCK

(71) Applicant: Peixia Chen, Guangdong (CN)

(72) Inventor: Peixia Chen, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/449,094

(22) Filed: Aug. 14, 2023

(65) Prior Publication Data

US 2024/0238688 A1 Jul. 18, 2024

Related U.S. Application Data

(63) Continuation-in-part of application No. 18/155,861, filed on Jan. 18, 2023, now Pat. No. 11,766,622.

(51) Int. Cl.
*A63H 33/04* (2006.01)

(52) U.S. Cl.
CPC ..... *A63H 33/046* (2013.01)

(58) Field of Classification Search
CPC ..... A63H 33/26; A63H 33/046
USPC ..... 446/92, 129, 132, 133
See application file for complete search history.

(56) References Cited

U.S. PATENT DOCUMENTS 3,601,921 A * 8/1971 Strohmaier ..... A63H 33/046 446/92
6,024,626 A * 2/2000 Mendelsohn ..... A63H 33/046 446/124
7,255,624 B2 * 8/2007 Daftari ..... A63H 33/22 446/485
9,751,025 B2 * 9/2017 Kiribuchi ..... A63H 33/046
11,103,801 B2 * 8/2021 Vicentelli ..... A63H 33/046
11,224,821 B2 * 1/2022 Rosen ..... H01F 7/0221
11,406,909 B2 * 8/2022 Zhang ..... A63H 33/26
11,458,410 B2 * 10/2022 Xu ..... A63H 33/046
11,766,622 B1 * 9/2023 Chen ..... A63H 33/046 446/92
2012/0309259 A1 * 12/2012 Mak ..... A63H 33/046 446/92
2015/0065007 A1 * 3/2015 Klepper ..... A63H 33/046 446/92
2015/0258462 A1 * 9/2015 Wei ..... A63H 33/06 446/92
2016/0199749 A1 * 7/2016 Whittaker ..... A63H 33/046 434/278
2019/0201804 A1 * 7/2019 Khalus ..... A63H 33/046

* cited by examiner

*Primary Examiner* — Joseph B Baldori

(57) ABSTRACT

A magnetic suction building block includes a building block main body, first magnets and a stop column assembly, where the building block main body is formed by a plurality of side walls in mutual connection, crossed corners are formed at joints between adjacent side walls, first compartments are disposed at the crossed corners; the first magnets are disposed inside the first compartments; and the first magnets can rotate in the first compartments, and each first magnet is provided with a N pole and a S pole; and the stop column assembly includes a plurality of stop columns for stopping the first magnets in the first compartments, so the magnetic suction building blocks may attract to each other through the first magnets arranged in the first compartments at the crossed corners and the magnetic suction building blocks may be mutually connected at the crossed corner.

11 Claims, 16 Drawing Sheets

MAGNETIC SUCTION BUILDING BLOCK

CROSS-REFERENCE TO RELATED APPLICATION

This application is a Continuation-in-Part of the U.S. application Ser. No. 18/155,861 filed on Jan. 18, 2023, and entitled "Magnetic suction building block" now pending, the entire disclosures of which are incorporated herein by reference.

TECHNICAL FIELD

The present disclosure relates to the technical field of building blocks, in particular to a magnetic suction building block.

BACKGROUND

As a toy that has become increasingly popular in recent years, a 3D magnetic suction intellective building block may be used to establish a three-dimensional shape and help develop children's imagination. The existing magnetic suction building block on the current market has single stacking angles, usually the magnetic suction building block may be stacked on a same axis, and the playing method is simple, so more connecting modes cannot be implemented. For example, the design and establishment of a misplaced modeling cannot be implemented, so the children's interest in modeling is greatly influenced. Therefore, it is urgent to provide a magnetic suction building block with various stacking angles, more connecting modes and rich playing methods on the market, so as to implement the design and establishment of the misplaced modeling, improve the children's interest in modeling and help develop the children's imagination.

SUMMARY

In order to overcome shortcomings in the prior art, the present disclosure provides a magnetic suction building block, including:

a building block main body, which is formed by a plurality of side walls in mutual connection, and crossed corners are formed at joints between the adjacent side walls; first compartments are disposed at the crossed corners; the plurality of side walls include a first surrounding wall group, an upper side wall and a lower side wall that are formed through successive connection, an upper side of the first surrounding wall group is connected to the upper side wall while a lower side is connected to the lower side wall, and the crossed corners are formed at joints between the first surrounding wall group and the upper side wall and between the first surrounding wall group and the lower side wall; each crossed corner includes a first crossed corner part and a second crossed corner part, each first compartment includes a first compartment part and a second compartment part, the first compartment part is disposed at the first crossed corner part formed at the joint of the upper side of the first surrounding wall group and the upper side wall, and the second compartment part is disposed at the second crossed corner part formed at the joint of the lower side of the first surrounding wall group and the lower side wall;

a first inner wall group, which is connected to an inner surface of the first surrounding wall group, the first inner wall group surrounds the inner surface of the first surrounding wall group to form a mounting slot group, and the mounting slot group is disposed between the first compartment part and the second compartment part;

a second inner wall group, which is connected to the inner surface of the upper side wall, the first compartment part is formed on the inner surfaces of the second inner wall group and the upper side wall, and the first compartment part mutually communicates with the mounting slot group;

a third inner wall group, which is connected to the inner surface of the lower side wall, the second compartment part is formed on the inner surfaces of the third inner wall group and the lower side wall, and the second compartment part mutually communicates with the mounting slot group;

first magnets, each of which includes a first magnet part and a second magnet part, the first magnet part is disposed in the first compartment part of the first compartment and capable of rotating in the first compartment part of the first compartment, and each first magnet is provided with a N pole and a S pole; and the second magnet part is disposed in the second compartment part of the first compartment and capable of rotating in the second compartment part of the first compartment, and the first magnet part and the second magnet part are provided with a N pole and a S pole, respectively;

a stop column assembly, which is disposed in the mounting slot group and includes a plurality of stop columns, and upper sides of the plurality of stop columns are used for stopping the first magnet part in the first compartment part while lower sides are used for stopping the second magnet part in the second compartment part.

As the improvement of the present disclosure, the building block main body is a square building block main body, the square building block main body is provided with six side walls, which are a front side wall, a rear side wall, a left side wall, a right side wall, an upper side wall and a lower side wall; the front side wall, the rear side wall, the left side wall and the right side wall are successively connected so as to form the first surrounding wall group; a right side of the front side wall is connected to the right side wall, upper sides of the front side wall and the right side wall are both connected to the upper side wall, and lower sides of the front side wall and the right side wall are both connected to the lower side wall; a left side of the front side wall is connected to the left side wall, upper sides of the front side wall and the left side wall are both connected to the upper side wall, and lower sides of the front side wall and the left side wall are both connected to the lower side wall; a left side of the rear side wall is connected to the right side wall, upper sides of the rear side wall and the right side wall are both connected to the upper side wall, and lower sides of the rear side wall and the right side wall are both connected to the lower side wall; and a right side of the rear side wall is connected to the left side wall, upper sides of the rear side wall and the left side wall are both connected to the upper side wall, and lower sides of the rear side wall and the left side wall are both connected to the lower side wall.

As the improvement of the present disclosure, the first crossed corner part includes a first crossed corner unit disposed at a joint among the front side wall, the right side wall and the upper side wall, a third crossed corner unit disposed at a joint among the front side wall, the left side wall and the upper side wall, a fifth crossed corner unit disposed at a joint among the rear side wall, the right side wall and the upper side wall, and a seventh crossed corner unit disposed at a joint among the rear side wall, the left side wall and the upper side wall; and the second crossed corner part includes a second crossed corner unit disposed at a joint among the front side wall, the right side wall and the lower side wall, a fourth crossed corner unit disposed at a joint among the front side wall, the left side wall and the lower side wall, a sixth crossed corner unit disposed at a joint among the rear side wall, the right side wall and the lower side wall, and an eighth crossed corner unit disposed at a joint among the rear side wall, the left side wall and the lower side wall.

As the improvement of the present disclosure, the first compartment part includes a first compartment unit disposed at the first crossed corner unit, a third compartment unit disposed at the third crossed corner unit, a fifth compartment unit disposed at the fifth crossed corner unit, and a seventh compartment unit disposed at the seventh crossed corner unit; and the second compartment part includes a second compartment unit disposed at the second crossed corner unit, a fourth compartment unit disposed at the fourth crossed corner unit, a sixth compartment unit disposed at the sixth crossed corner unit, and an eighth compartment unit disposed at the eighth crossed corner unit As the improvement of the present disclosure, the first magnet part includes a first magnet unit disposed at the first compartment unit, a third magnet unit disposed at the third compartment unit, a fifth magnet unit disposed at the fifth compartment unit, and a seventh magnet unit disposed at the seventh compartment unit; and the second magnet part includes a second magnet unit disposed at the second compartment unit, a fourth magnet unit disposed at the fourth compartment unit, a sixth magnet unit disposed at the sixth compartment unit, and an eighth magnet unit disposed at the eighth compartment unit.

As the improvement of the present disclosure, the mounting slot group includes a first mounting slot disposed between the first compartment unit and the second compartment unit, a second mounting slot disposed between the third compartment and the fourth compartment, a third mounting slot disposed between the fifth compartment and the sixth compartment and a fourth mounting slot disposed between the seventh compartment and the eighth compartment; the stop column assembly includes a first stop column, a second stop column, a third stop column and a fourth stop column, the first stop column is disposed in the first mounting slot, the second stop column is disposed in the second mounting slot, the third stop column is disposed in the third mounting slot, and the fourth stop column is disposed in the fourth mounting slot; an upper side of the first stop column stops the first magnet unit in the first compartment unit, and a lower side of the first stop column stops the second magnet unit in the second compartment unit; an upper side of the second stop column stops the third magnet unit in the third compartment unit, and a lower side of second stop column stops the fourth magnet unit in the fourth compartment unit; an upper side of the third stop column stops the fifth magnet unit in the fifth compartment unit, and a lower side of the third stop column stops the sixth magnet unit in the sixth compartment unit; and an upper side of the fourth stop column stops the seventh magnet unit in the seventh compartment unit, and a lower side of the fourth stop column stops the eighth magnet unit in the eighth compartment unit.

As the improvement of the present disclosure, the first stop column, the second stop column, the third stop column and the fourth stop column are spaced from each other, so the first stop column, the second stop column, the third stop column and the fourth stop column that are mutually independent and in an individual form are formed. The building block main body is made of a light-transmitting material.

As the improvement of the present disclosure, further including a connecting shaft, the first stop column, the second stop column, the third stop column and the fourth stop column are all connected to the connecting shaft, and the first stop column, the second stop column, the third stop column and the fourth stop column are uniformly arranged around a circumferential direction of the connecting shaft.

As the improvement of the present disclosure, an inner wall of the building block main body is also provided with a second compartment, and the second compartment is provided with a second magnet, which may be slide in the second compartment.

As the improvement of the present disclosure, further including a second installation bracket, which is disposed in the second compartment, so as to at least divide the second compartment into a ninth compartment unit and a tenth compartment unit; the second magnet includes a ninth magnet unit and a tenth magnet unit, and the ninth magnet unit is disposed in the ninth compartment unit and capable of sliding in the ninth compartment unit; and the tenth magnet unit is disposed in the tenth compartment unit and capable of sliding in the tenth compartment unit.

The present disclosure further provides a production process for a magnetic suction building block, including the following steps of:

providing a building block main body, where the building block main body includes a first surrounding wall group, an upper side wall, a lower side wall, a first inner wall group, a third inner wall group and a second inner wall group, a lower side of the first surrounding wall group is connected to the lower side wall, and a second crossed corner part is formed at a joint between the lower side of the first surrounding wall group and the lower side wall; the third inner wall group is connected to an inner surface of the lower side wall, and a second compartment part is formed on inner surfaces of the third inner wall group and the lower side wall; and the first inner wall group is connected to an inner surface of the first surrounding wall group, the first inner wall group surrounds the inner surface of the first surrounding wall group to form a mounting slot group, and the mounting slot group communicates with the second compartment part;

providing first magnets, each of which includes a first magnet part and a second magnet part; the second magnet part is placed in the second compartment part and capable of rotating in the second compartment part, and the first magnet part and the second magnet part are both provided with a N pole and a S pole;

providing a stop column assembly, which includes a plurality of stop columns, and the plurality of stop columns are placed in the mounting slot group, so that lower sides of the plurality of stop columns stop the second magnet part in the second compartment part;

where the first magnet parts are placed at upper sides of the plurality of stop columns, and the upper side wall is connected to the upper side of the first surrounding wall group; and the second inner wall group is connected to the inner surface of the upper side wall, the first compartment part is formed on the inner surfaces of the second inner wall group and the upper side wall, and the first compartment part communicates with the mounting slot group, so that the upper sides of the plurality of stop columns stop the first magnet part in the first compartment part, and the first magnet part may rotate in the first compartment part.

As the improvement of the present disclosure, the upper side wall is connected to the upper side of the first surrounding wall group by an ultrasonic hot melting mode or an adhesive mode.

The present disclosure further provides a magnetic suction building block, including a building block main body, where the building block main body is formed by a plurality of side walls in mutual connection, crossed corners are formed at joints between adjacent side walls, first compartments are disposed at the crossed corners, and first magnets are disposed inside the first compartments; and the first magnets may rotate in the first compartments, and each first magnet is provided with a N pole and a S pole.

As the improvement of the present disclosure, the building block main body is a square building block main body, the building block main body is provided with six side walls, which are a front side wall, a rear side wall, a left side wall, a right side wall, an upper side wall and a lower side wall; a right side of the front side wall is connected to the right side wall, upper sides of the front side wall and the right side wall are both connected to the upper side wall, and lower sides of the front side wall and the right side wall are both connected to the lower side wall; a left side of the front side wall is connected to the left side wall, upper sides of the front side wall and the left side wall are both connected to the upper side wall, and lower sides of the front side wall and the left side wall are both connected to the lower side wall; a left side of the rear side wall is connected to the right side wall, upper sides of the rear side wall and the right side wall are both connected to the upper side wall, and lower sides of the rear side wall and the right side wall are both connected to the lower side wall; and a right side of the rear side wall is connected to the left side wall, upper sides of the rear side wall and the left side wall are both connected to the upper side wall, and lower sides of the rear side wall and the left side wall are both connected to the lower side wall.

As the improvement of the present disclosure, the crossed corner includes a first crossed corner unit disposed at a joint among the front side wall, the right side wall and the upper side wall, a second crossed corner unit disposed at a joint among the front side wall, the right side wall and the lower side wall, a third crossed corner unit disposed at a joint among the front side wall, the left side wall and the upper side wall, a fourth crossed corner unit disposed at a joint among the front side wall, the left side wall and the lower side wall, a fifth crossed corner unit disposed at a joint among the rear side wall, the right side wall and the upper side wall, a sixth crossed corner unit disposed at a joint among the rear side wall, the right side wall and the lower side wall, a seventh crossed corner unit disposed at a joint among the rear side wall, the left side wall and the upper side wall, and an eighth crossed corner unit disposed at a joint among the rear side wall, the left side wall and the lower side wall.

As the improvement of the present disclosure, the first compartment includes a first compartment unit disposed at the first crossed corner unit, a second compartment unit disposed at the second crossed corner unit, a third compartment unit disposed at the third crossed corner unit, a fourth compartment unit disposed at the fourth crossed corner unit, a fifth compartment unit disposed at the fifth crossed corner unit, a sixth compartment unit disposed at the sixth crossed corner unit, a seventh compartment unit disposed at the seventh crossed corner unit, and an eighth compartment unit disposed at the eighth crossed corner unit.

As the improvement of the present disclosure, the first magnet includes a first magnet unit disposed at the first compartment unit, a second magnet unit disposed at the second compartment unit, a third magnet unit disposed at the third compartment unit, a fourth magnet unit disposed at the fourth compartment unit, a fifth magnet unit disposed at the fifth compartment unit, a sixth magnet unit disposed at the sixth compartment unit, a seventh magnet unit disposed at the seventh compartment unit, and an eighth magnet unit disposed at the eighth compartment unit.

As the improvement of the present disclosure, the first compartment is provided with an installation opening, and the first magnet is placed in the first compartment through the installation opening; the magnetic suction building block further includes a first installation bracket, an accommodating cavity is formed among the left side wall, the right side wall, the front side wall, the rear side wall and the lower side wall, the accommodating cavity is provided with an accommodating opening, and when the first installation bracket is placed in the accommodating cavity through the accommodating opening, the upper side wall covers the accommodating opening, so that the first installation bracket stops the first magnet in the first compartment.

As the improvement of the present disclosure, the first installation bracket includes a connecting shaft, a locating shaft hole is formed in the connecting shaft, the upper side wall is provided with a locating shaft, and when the upper side wall covers the accommodating opening, the locating shaft is sleeved on the locating shaft hole.

As the improvement of the present disclosure, the connecting shaft is provided with a first stop column, a second stop column, a third stop column and a fourth stop column, and the first stop column, the second stop column, the third stop column and the fourth stop column are arranged uniformly along a circumferential direction of the connecting shaft; an upper side of the first stop column stops the first magnet unit in the first compartment unit, and a lower side of the first stop column stops the second magnet unit in the second compartment unit; an upper side of the second stop column stops the third magnet unit in the third compartment unit, and a lower side of the second stop column stops the fourth magnet unit in the fourth compartment unit; an upper side of the third stop column stops the fifth magnet unit in the fifth compartment unit, and a lower side of the third stop column stops the sixth magnet unit in the sixth compartment unit; and an upper side of the fourth stop column stops the seventh magnet unit in the seventh compartment unit, and a lower side of the fourth stop column stops the eighth magnet unit in the eighth compartment unit.

As the improvement of the present disclosure, a first slot, a second slot, a third slot and a fourth slot are also arranged inside the accommodating cavity, a first stop side is disposed on the first slot, the first stop side is used to stop the first stop column, so that a distance between a lower side of the first stop column and the lower side wall is fixed, and the second magnet unit can rotate in the second compartment unit; a second stop side is disposed on the second slot, the second stop side is used to stop the second stop column, so that a distance between a lower side of the second stop column and the lower side wall is fixed, and the fourth magnet unit can rotate in the fourth compartment unit; a third stop side is disposed on the third slot, the third stop side is used to stop the third stop column, so that a distance between a lower side of the third stop column and the lower side wall is fixed, and the sixth magnet unit can rotate in the sixth compartment unit; and a fourth stop side is disposed on the fourth slot, the fourth stop side is used to stop the fourth stop column, so that a distance between a lower side of the fourth stop column and the lower side wall is fixed, and the eighth magnet unit can rotate in the eighth compartment unit.

The present disclosure has the following beneficial effects: the present disclosure provides a magnetic suction building block, including a building block main body, first magnets and a stop column assembly, where the building block main body is formed by a plurality of side walls in mutual connection, crossed corners are formed at joints between adjacent side walls, first compartments are disposed at the crossed corners; the first magnets are disposed inside the first compartments; and the first magnets can rotate in the first compartments, and each first magnet is provided with a N pole and a S pole; and the stop column assembly includes a plurality of stop columns for stopping the first magnets in the first compartments, so the magnetic suction building blocks may attract to each other through the first magnets arranged in the first compartments at the crossed corners and the magnetic suction building blocks may be mutually connected at the crossed corners, thereby implementing the misplaced connection among the magnetic suction building blocks and implementing the design and building of the misplaced shapes. Compared with the magnetic suction building blocks that can only be stacked on the same axis in the existing technology, the building mode and playing method of the magnetic suction building block provided by the present disclosure are greatly enriched, so as to help children build more shapes, built various pattern combinations in combination with the surface patterns of the magnetic suction building block, greatly improve the children's interest in building and modeling and help develop the children's imagination. Further, since the first magnets may rotate in the first compartments and are provided with the N pole and the S pole, when the magnetic suction building blocks are mutually stacked at the crossed corners, the first magnets of the magnetic suction building blocks may easily guide the N pole of the magnetic suction building block to be tightly absorbed with the S pole of another same magnetic suction building block by rotating, or guide the S pole of the magnetic suction building block to be tightly absorbed with the N pole of another same magnetic suction building block by rotating, so as to implement a stable connection among the magnetic suction building blocks, implement a misplaced connection among the magnetic suction building blocks, and implement the design and building of the misplaced shapes.

BRIEF DESCRIPTION OF THE DRAWINGS

To better clarify the technical solution in the embodiments of the present disclosure, the drawings required to illustrate the embodiments will be simply described below. The drawings described below merely illustrate some embodiments of the present disclosure. Those ordinarily skilled in the art can obtain other drawings without contributing creative labor on the basis of those drawings.

The present disclosure is further described below in combination with drawings and embodiments.

DETAILED DESCRIPTION OF THE EMBODIMENTS

Embodiment I

Figure 1:
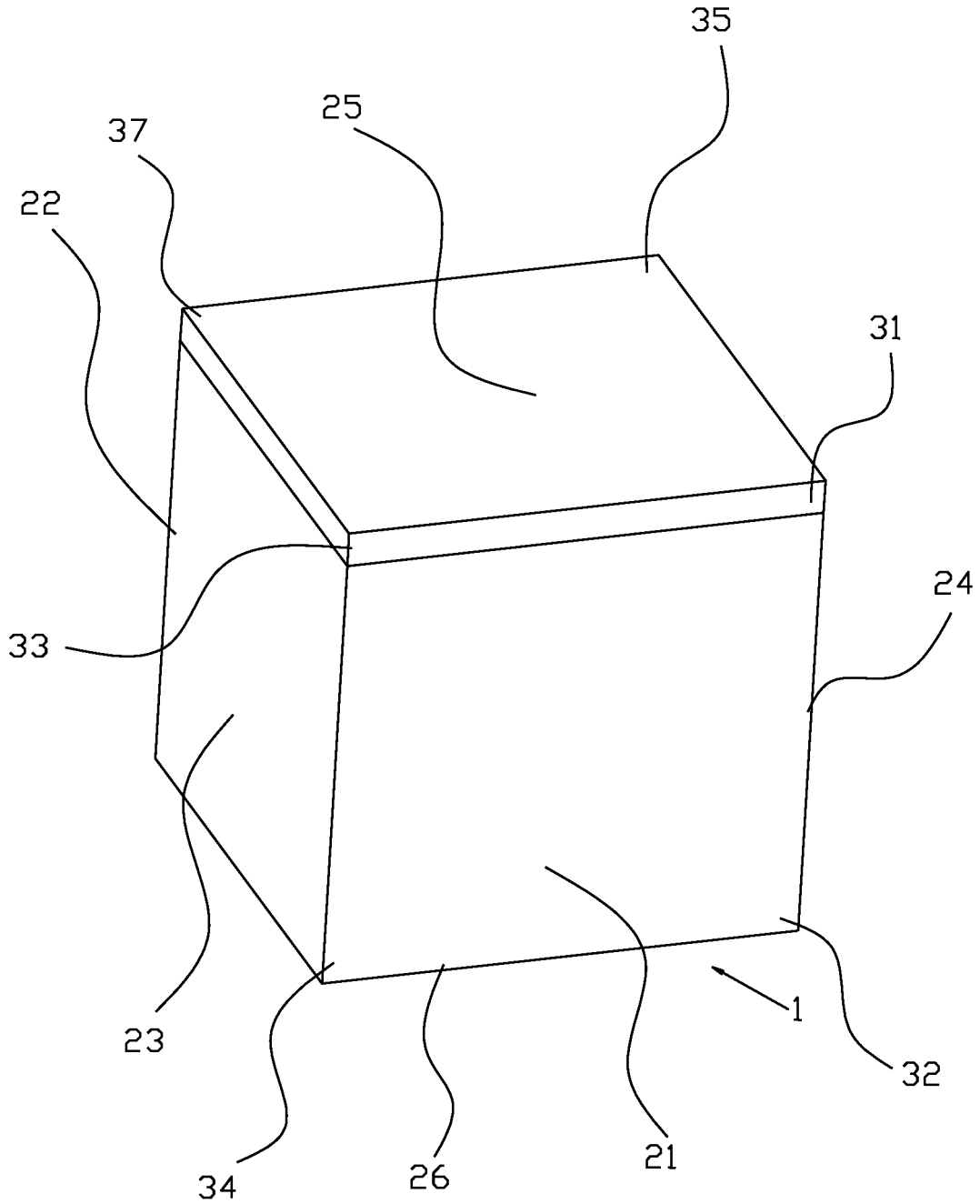
FIG. 1 is a schematic diagram of an overall structure of the present disclosure.
Figure 2:
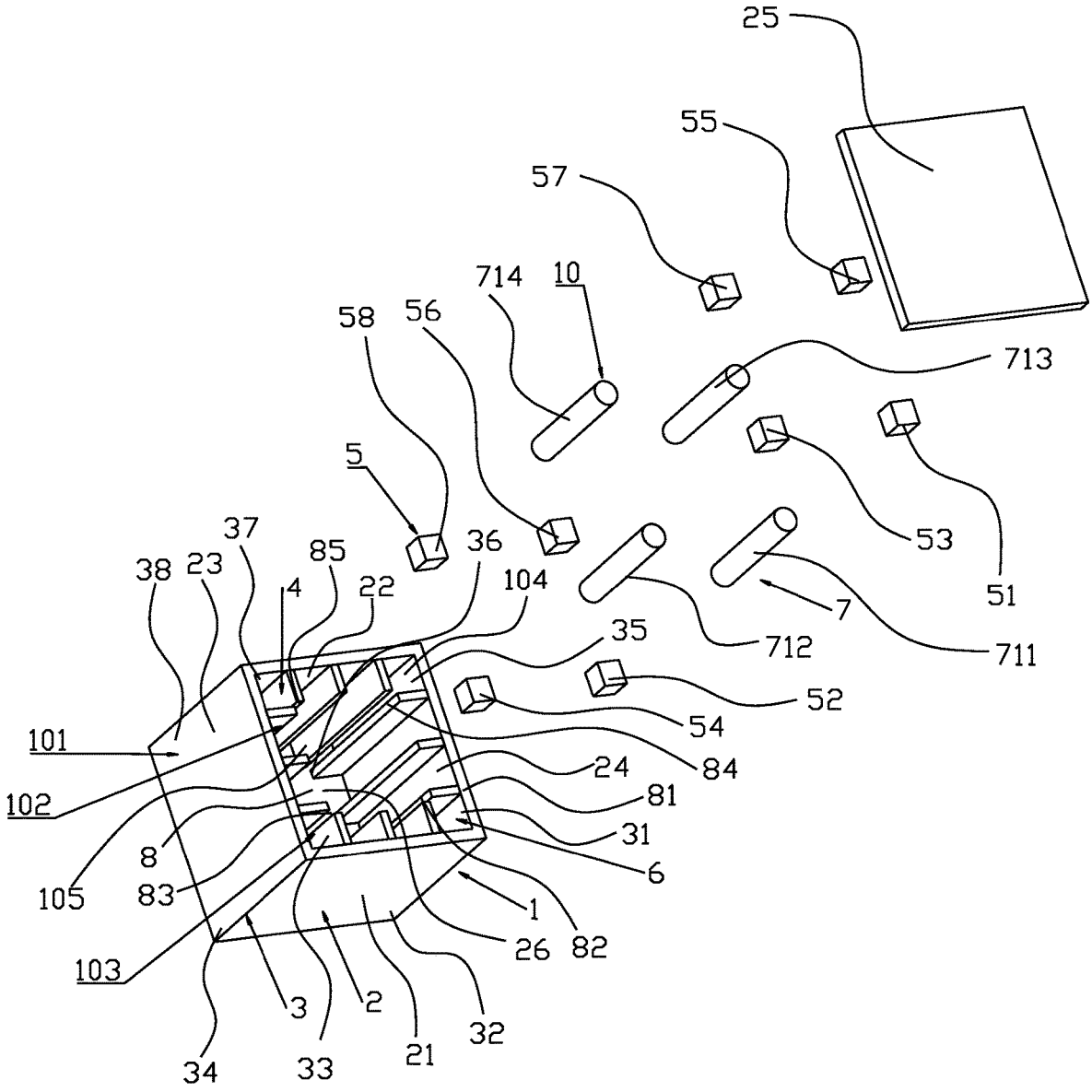
FIG. 2 is an exploded drawing of Embodiment I of the present disclosure.
Figure 10:
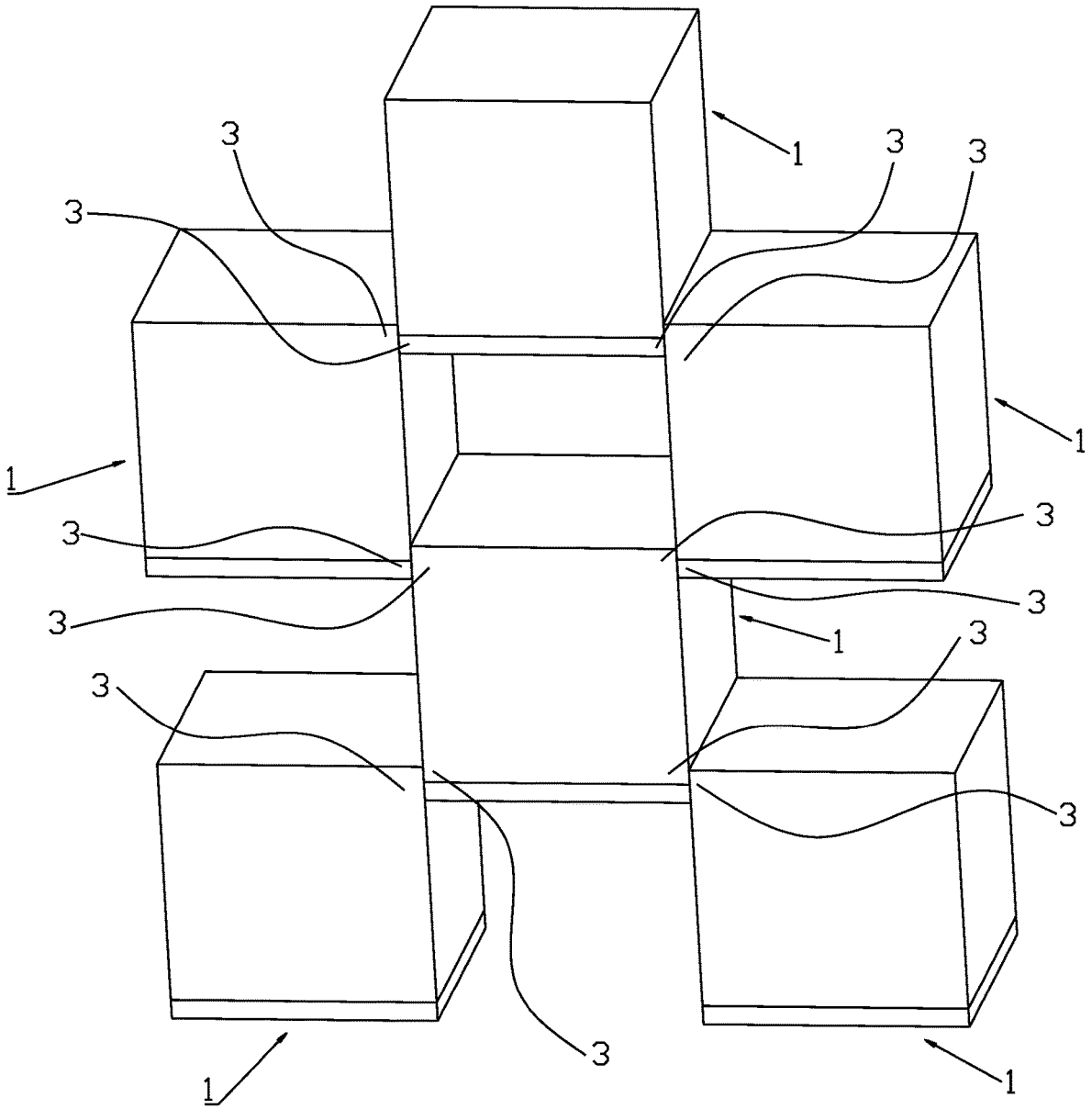
FIG. 10 is a schematic diagram of an overall structure of a misplaced shape formed by building when magnetic suction toys are mutually connected at crossed corners in the present disclosure.
Figure 11:
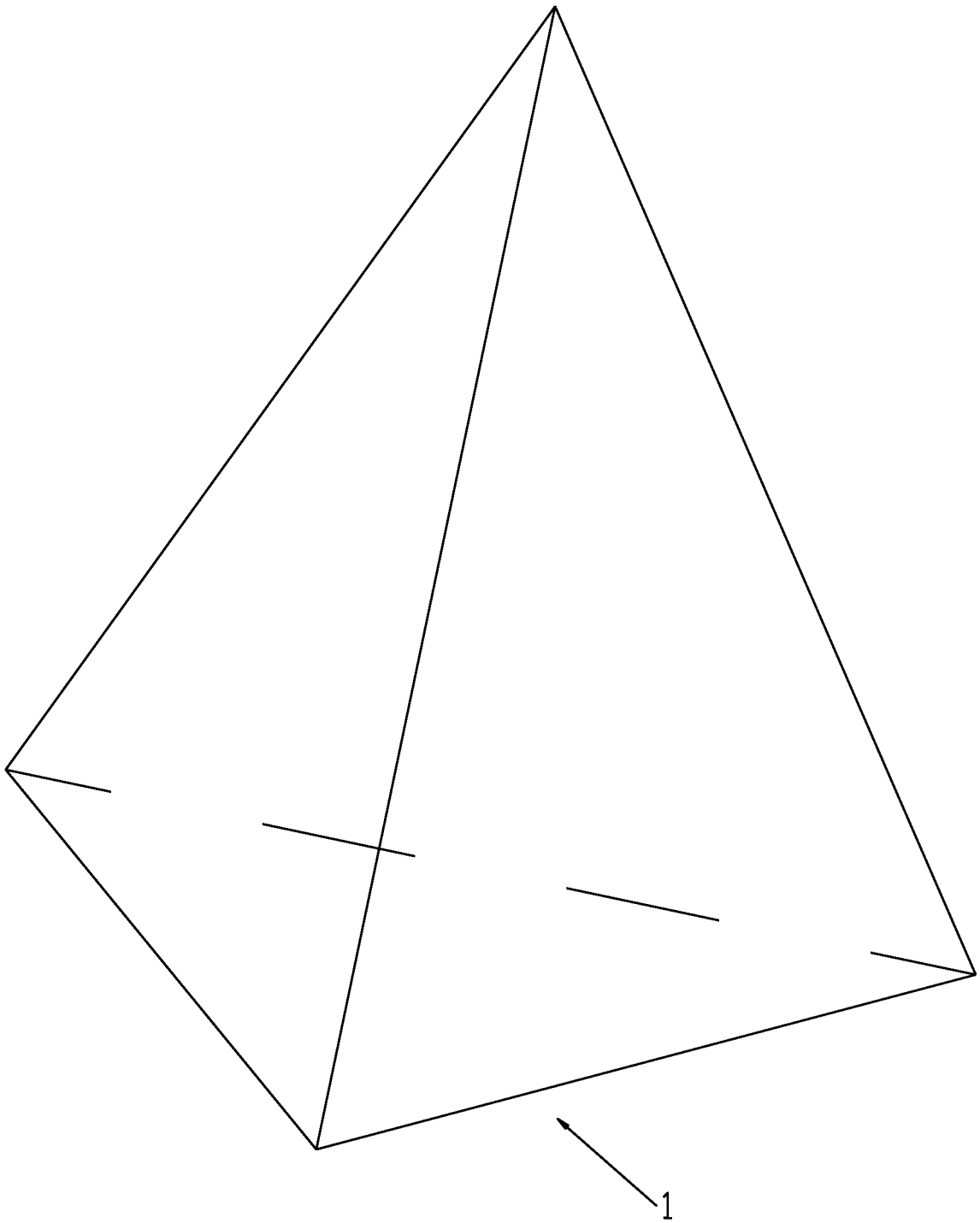
FIG. 11 is a structural schematic diagram when a building block main body is a triangular pyramid shape in the present disclosure.
Figure 12:
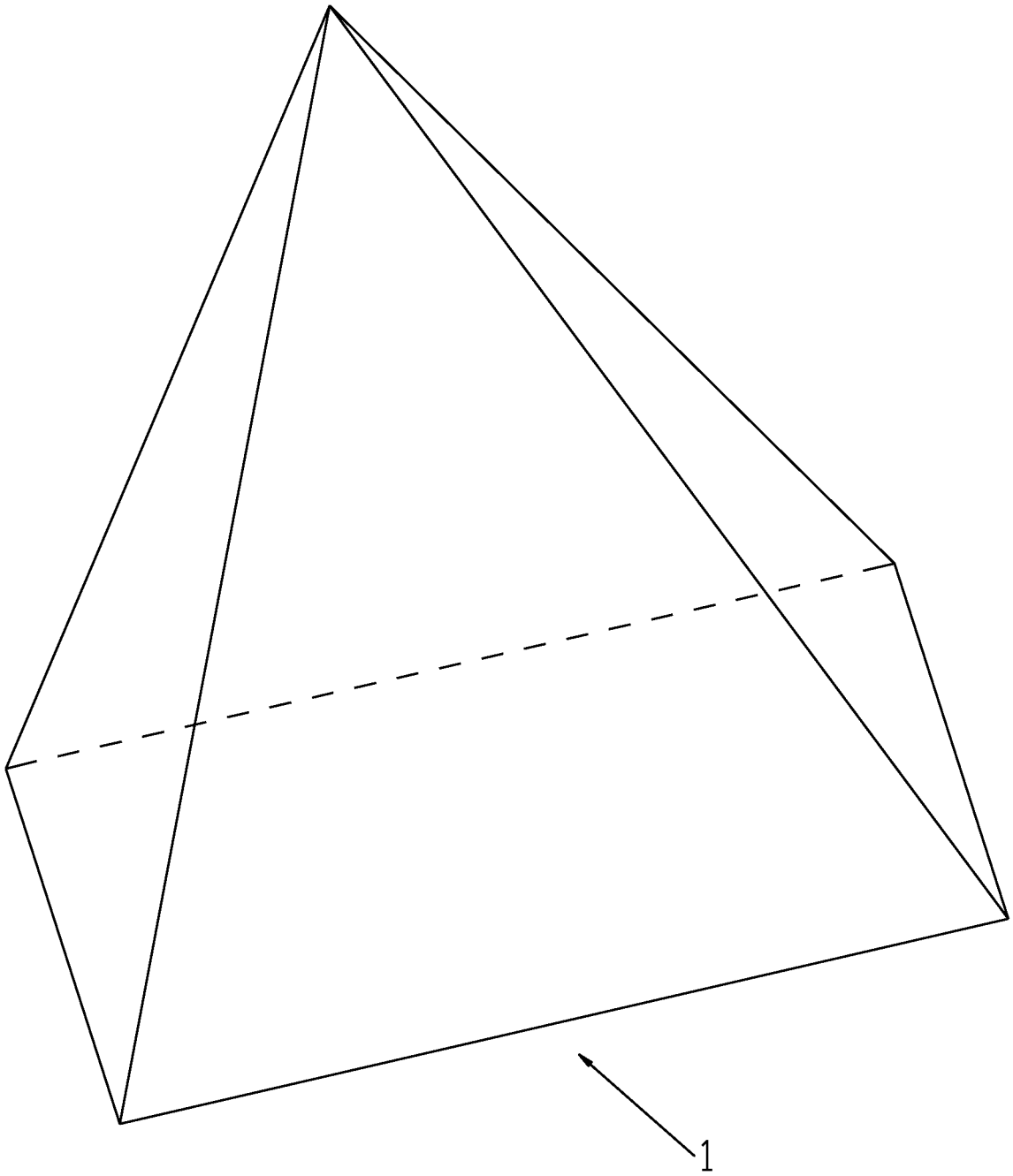
FIG. 12 is a structural schematic diagram when a building block main body is a rectangular pyramid shape in the present disclosure.
Figure 13:
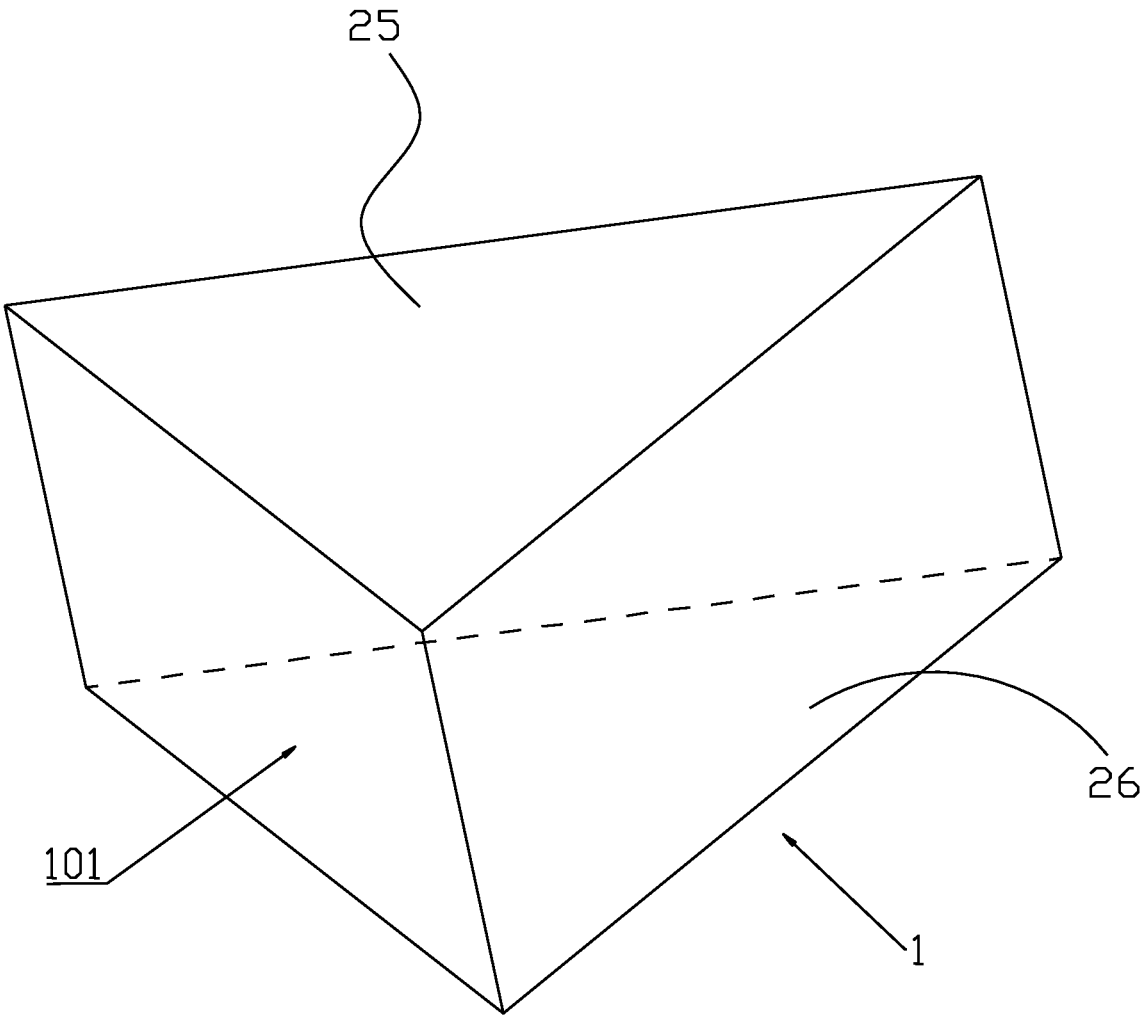
FIG. 13 is a structural schematic diagram when a building block main body is a triangular prism shape in the present disclosure.
Figure 14:
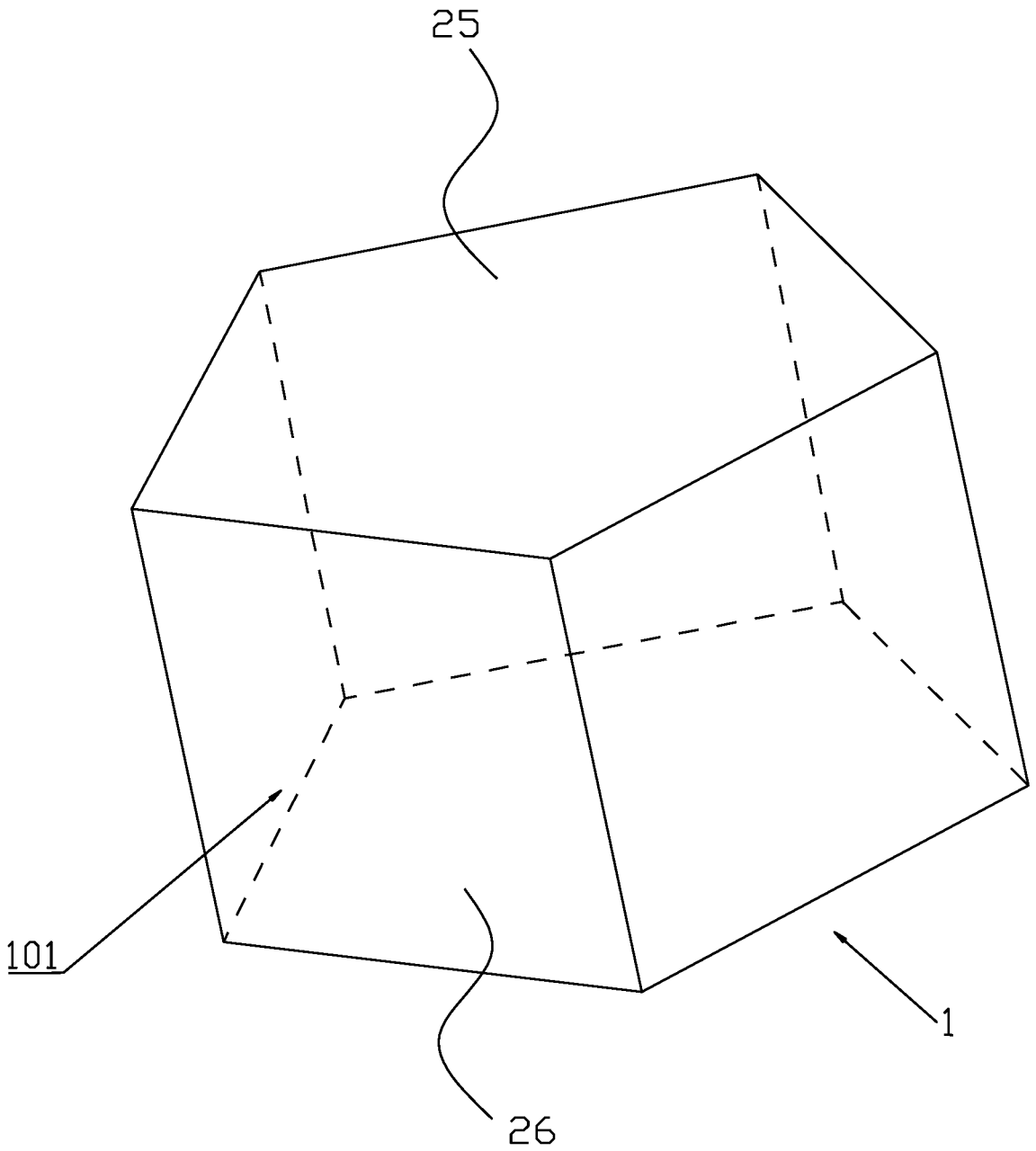
FIG. 14 is a structural schematic diagram when a building block main body is a pentagonal prism shape in the present disclosure.
Figure 15:
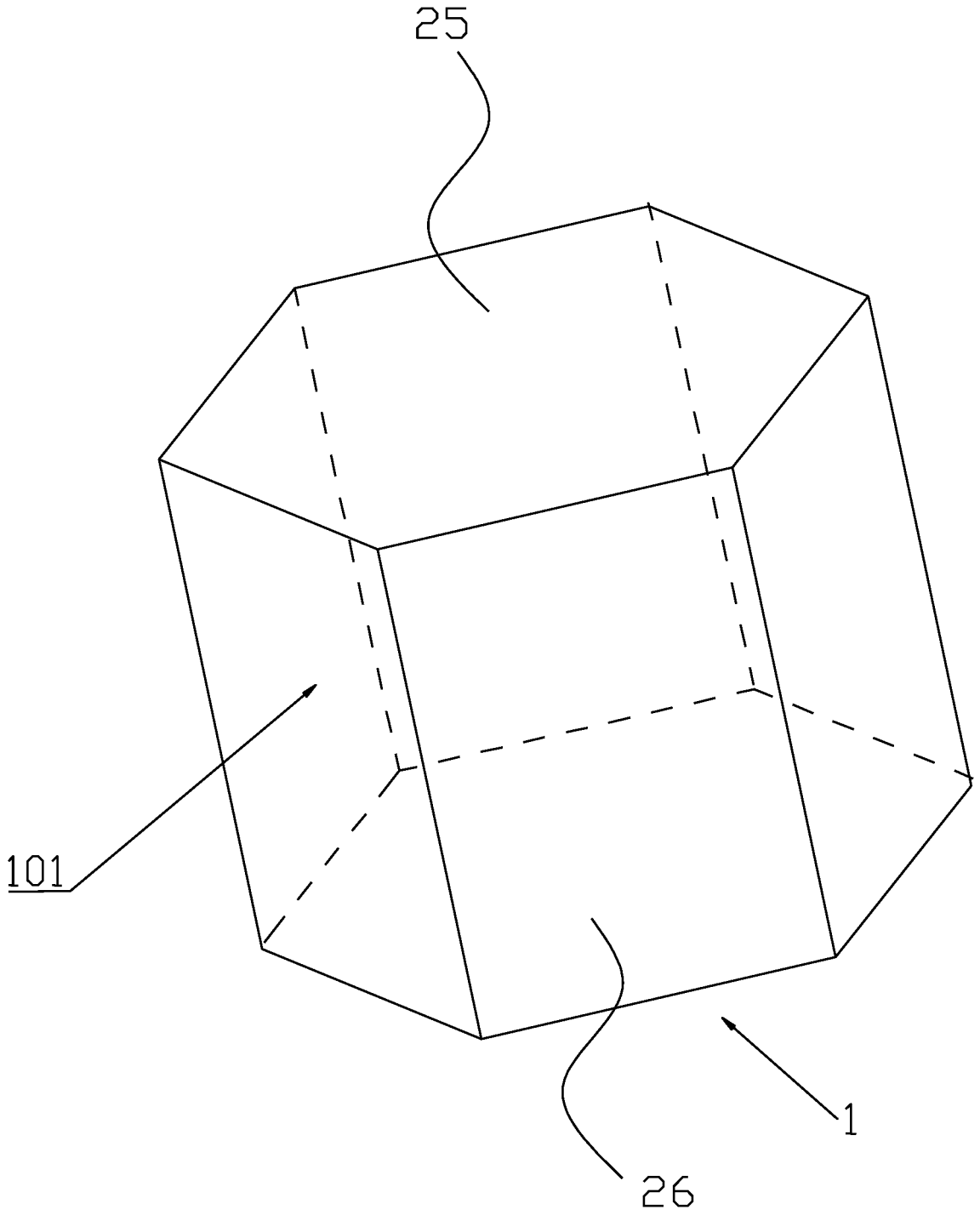
FIG. 15 is a structural schematic diagram when a building block main body is a hexagonal prism shape in the present disclosure.

Referring to FIG. 1, FIG. 2 and FIG. 10, a magnetic suction building block, including:

a building block main body 1, which is formed by a plurality of side walls 2 in successive connection, and crossed corners 3 are formed at joints between the adjacent side walls 2; first compartments 4 are disposed at the crossed corners 3; a plurality of side walls 2 include a first surrounding wall group 101, an upper side wall 25 and a lower side wall 26 that are formed through successive connection, an upper side of the first surrounding wall group 101 is connected to the upper side wall 25 while a lower side is connected to the lower side wall 26, the crossed corners 3 are formed at joints between the first surrounding wall group 101 and the upper side wall and between the first surrounding wall group 101 and the lower side wall; each crossed corner 3 includes a first crossed corner part and a second crossed corner part, each first compartment 4 includes a first compartment part and a second compartment part, the first compartment part is disposed at the first crossed corner part formed at the joint of the upper side of the first surrounding wall group and the upper side wall, and the second compartment part is disposed at the second crossed corner part formed at the joint of the lower side of the first surrounding wall group and the lower side wall;

a first inner wall group 102, which is connected to an inner surface of the first surrounding wall group 101, the first inner wall group 102 surrounds the inner surface of the first surrounding wall group 101 to form a mounting slot group 103, and the mounting slot group 103 is disposed between the first compartment part and the second compartment part;

a second inner wall group 104, which is connected to the inner surface of the upper side wall 25, the first compartment part is formed on the inner surfaces of the second inner wall group 104 and the upper side wall 25, and the first compartment part mutually communicates with the mounting slot group 103;

a third inner wall group 105, which is connected to the inner surface of the lower side wall 26, the second compartment part is formed on the inner surfaces of the third inner wall group 105 and the lower side wall 26, and the second compartment part mutually communicates with the mounting slot group 103;

first magnets 5, each of which includes a first magnet part and a second magnet part, the first magnet part is disposed in the first compartment part of the first compartment 4 and capable of rotating in the first compartment part 4 of the first compartment, and the first magnet part is provided with a N pole and a S pole; and the second magnet part is disposed in the second compartment part of the first compartment 4 and capable of rotating in the second compartment part 4 of the first compartment, and the first magnet part and the second magnet part are provided with a N pole and a S pole, respectively;

a stop column assembly 10, which is disposed in the mounting slot group 103 and includes a plurality of stop columns, and upper sides of the plurality of stop columns are used to stop the first magnet part in the first compartment part while lower sides are used to stop the second magnet part in the second compartment part.

Through the above structure, the magnetic suction building blocks may attract to each other through the first magnets arranged in the first compartments at the crossed corners, so that the magnetic suction building blocks may be mutually connected at the crossed corners, thereby implementing the misplaced connection among the magnetic suction building blocks and implementing the design and building of the misplaced shapes. Compared with the magnetic suction building blocks that can only be stacked on the same axis in the existing technology, the building mode and playing method of the magnetic suction building block provided by the present disclosure are greatly enriched, so as to help children build more shape, and various pattern combinations may be built in combination with surface patterns of the magnetic suction building blocks, so as to greatly improve the children's interest in modeling and help develop the children's imagination. Further, since the first magnet may rotate in the first compartment and is provided with the N pole and the S pole, when the magnetic suction building blocks are mutually stacked at the crossed corners, the first magnets of the magnetic suction building blocks may easily guide the N pole of the magnetic suction building block to be tightly absorbed with the S pole of another same magnetic suction building block by rotating, or guide the S pole of the magnetic suction building block to be tightly absorbed with the N pole of another same magnetic suction building block by rotating, so as to implement a stable connection among the magnetic suction building blocks, implement a misplaced connection among the magnetic suction building blocks, and implement the design and building of the misplaced shapes. Referring to FIGS. 11 to 15, the building block main body may be a triangular prism or a rectangular pyramid or a pentagonal prism or a hexagonal prism or other shapes. It is noted that FIGS. 11 to 15 only illustrate several different shapes of the building block, and do not illustrate other structures.

In this embodiment, the building block main body 1 is a square building block main body, the square building block main body 1 is provided with six side walls 2, which are a front side wall 21, a rear side wall 22, a left side wall 23, a right side wall 24, an upper side wall 25 and a lower side wall 26; the first side wall 21, the rear side wall 22, the left side wall 23 and the right side wall 24 are successively connected so as to form the first surrounding wall group 101, a right side of the front side wall 21 is connected to the right side wall 24, upper sides of the front side wall 21 and the right side wall 24 are both connected to the upper side wall 25, and lower sides of the front side wall 21 and the right side wall 24 are both connected to the lower side wall 26; a left side of the front side wall 21 is connected to the left side wall 23, upper sides of the front side wall 21 and the left side wall 23 are both connected to the upper side wall 25, and lower sides of the front side wall 21 and the left side wall 23 are both connected to the lower side wall 26; a left side of the rear side wall 22 is connected to the right side wall 24, upper sides of the rear side wall 22 and the right side wall 24 are both connected to the upper side wall 25, and lower sides of the rear side wall 22 and the right side wall 24 are both connected to the lower side wall 26; and a right side of the rear side wall 22 is connected to the left side wall 23, upper sides of the rear side wall 22 and the left side wall 23 are both connected to the upper side wall 25, and lower sides of the rear side wall 22 and the left side wall 23 are both connected to the lower side wall 26. The first crossed corner part includes a first crossed corner unit 31 disposed at a joint among the front side wall 21, the right side wall 24 and the upper side wall 25, a third crossed corner unit 33 disposed at a joint among the front side wall 21, the left side wall 23 and the upper side wall 25, a fifth crossed corner unit 35 disposed at a joint among the rear side wall 22, the right side wall 24 and the upper side wall 25, and a seventh crossed corner unit 37 disposed at a joint among the rear side wall 22, the left side wall 23 and the upper side wall 25; and the second crossed corner part includes a second crossed corner unit 32 disposed at a joint among the front side wall 21, the right side wall 24 and the lower side wall 26, a fourth crossed corner unit 34 disposed at a joint among the front side wall 21, the left side wall 23 and the lower side wall 26, a sixth crossed corner unit 36 disposed at a joint among the rear side wall 22, the right side wall 24 and the lower side wall 26, and an eighth crossed corner unit 38 disposed at a joint among the rear side wall 22, the left side wall 23 and the lower side wall 26. Specifically, the first compartment part includes a first compartment unit 41 disposed at the first crossed corner unit 31, a third compartment unit 43 disposed at the third crossed corner unit 33, a fifth compartment unit 45 disposed at the fifth crossed corner unit 35, and a seventh compartment unit 47 disposed at the seventh crossed corner unit 37; and the second compartment part includes a second compartment unit 42 disposed at the second crossed corner unit 32, a fourth compartment unit 44 disposed at the fourth crossed corner unit 34, a sixth compartment unit 46 disposed at the sixth crossed corner unit 36, and an eighth compartment unit 48 disposed at the eighth crossed corner unit 38. Further, the first magnet part includes a first magnet unit 51 disposed at the first compartment unit 41, a third magnet unit 53 disposed at the third compartment unit 43, a fifth magnet unit 55 disposed at the fifth compartment unit 45, and a seventh magnet unit 57 disposed at the seventh compartment unit 47; and the second magnet part includes a second magnet part 52 disposed at the second compartment unit 42, a fourth magnet unit 54 disposed at the fourth compartment unit 44, a sixth magnet unit 56 disposed at the sixth compartment unit 46, and an eighth magnet unit 58 disposed at the eighth compartment unit 48. More further, the mounting slot group includes a first mounting slot disposed between the first compartment unit and the second compartment unit, a second mounting slot disposed between the third compartment and the fourth compartment, a third mounting slot disposed between the fifth compartment and the sixth compartment and a fourth mounting slot disposed between the seventh compartment and the eighth compartment; the stop column assembly 10 includes a first stop column 711, a second stop column 712, a third stop column 713 and a fourth stop column 714, the first stop column is disposed in the first mounting slot, the second stop column is disposed in the second mounting slot, the third stop column is disposed in the third mounting slot, the fourth stop column is disposed in the fourth mounting slot; an upper side of the first stop column 711 stops the first magnet unit 51 in the first compartment unit 41, and a lower side of the first stop column 711 stops the second magnet unit 52 in the second compartment unit 42; an upper side of the second stop column 712 stops the third magnet unit 53 in the third compartment unit 43, and a lower side of second stop column 712 stops the fourth magnet unit 54 in the fourth compartment unit 44; an upper side of the third stop column 713 stops the fifth magnet unit 55 in the fifth compartment unit 45, and a lower side of the third stop column 713 stops the sixth magnet unit 56 in the sixth compartment unit 46; and an upper side of the fourth stop column 714 stops the seventh magnet unit 57 in the seventh compartment unit 47, and a lower side of the fourth stop column 714 stops the eighth magnet unit 58 in the eighth compartment unit 48. Through the above structure with a reasonable design, a simple structure and a stable connection and by setting the first magnets in the first corner unit, the second corner unit, the third corner unit, the fourth corner unit, the fifth corner unit, the sixth corner unit, the seventh corner unit and the eighth corner unit of the square building block, various magnetic suction building blocks may be mutually misplaced, connected and stacked at the corner of each side wall, so as to implement the design and building of the misplaced shapes.

In this embodiment, the first stop column 711, the second stop column 712, the third stop column 713 and the fourth stop column 714 are spaced from each other, so the first stop column 711, the second stop column 712, the third stop column 713 and the fourth stop column 714 that are mutually independent and in an individual form are formed. Through the above structure, the first stop column 711, the second stop column 712, the third stop column 713 and the fourth stop column 714 that are spaced from each other and in the individual form may be convenient for the installation of the magnetic suction building block, with a low requirement on the assembly precision and a capacity of effectively providing the production efficiency and the yield. Moreover, the first stop column 711, the second stop column 712, the third stop column 713 and the fourth stop column 714 that are mutually independent and in individual forms omit the connecting structure among the stop columns, thereby further reducing the product dead weight and increasing the magnetism of the magnetic suction building block. The building block main body is made of a light-transmitting material. Since the building block main body is made of a light-transmitting material, the first stop column 711, the second stop column 712, the third stop column 713 and the fourth stop column 714 that are mutually independent and in individual forms have more beautiful appearance than the first stop column, the second stop column, the third stop column and the fourth stop column that are connected by the connecting shaft, so that the whole shape built by the building block main body is more beautiful.

Figure 3:
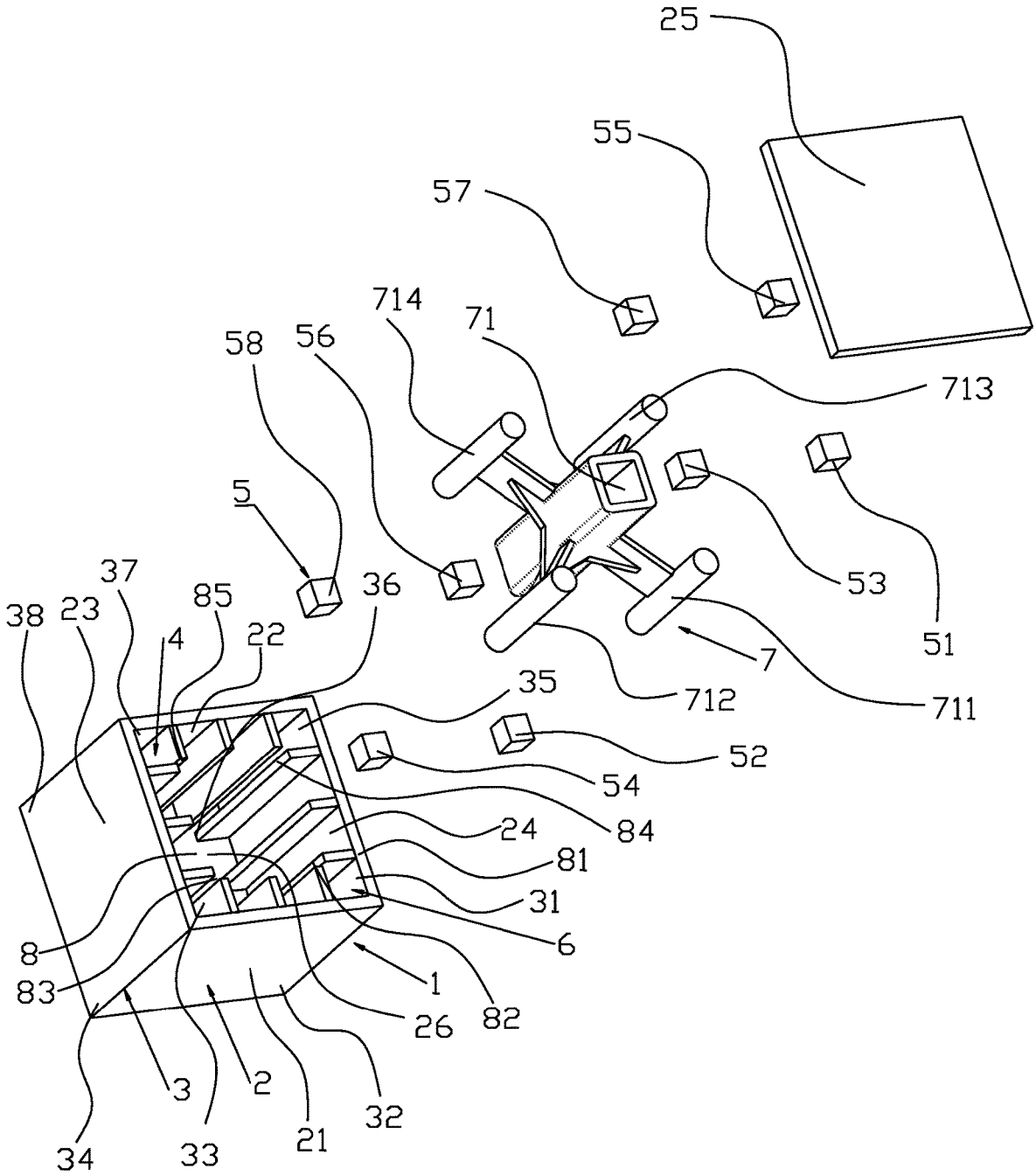
FIG. 3 is an exploded drawing of Embodiment II of the present disclosure.
Figure 4:
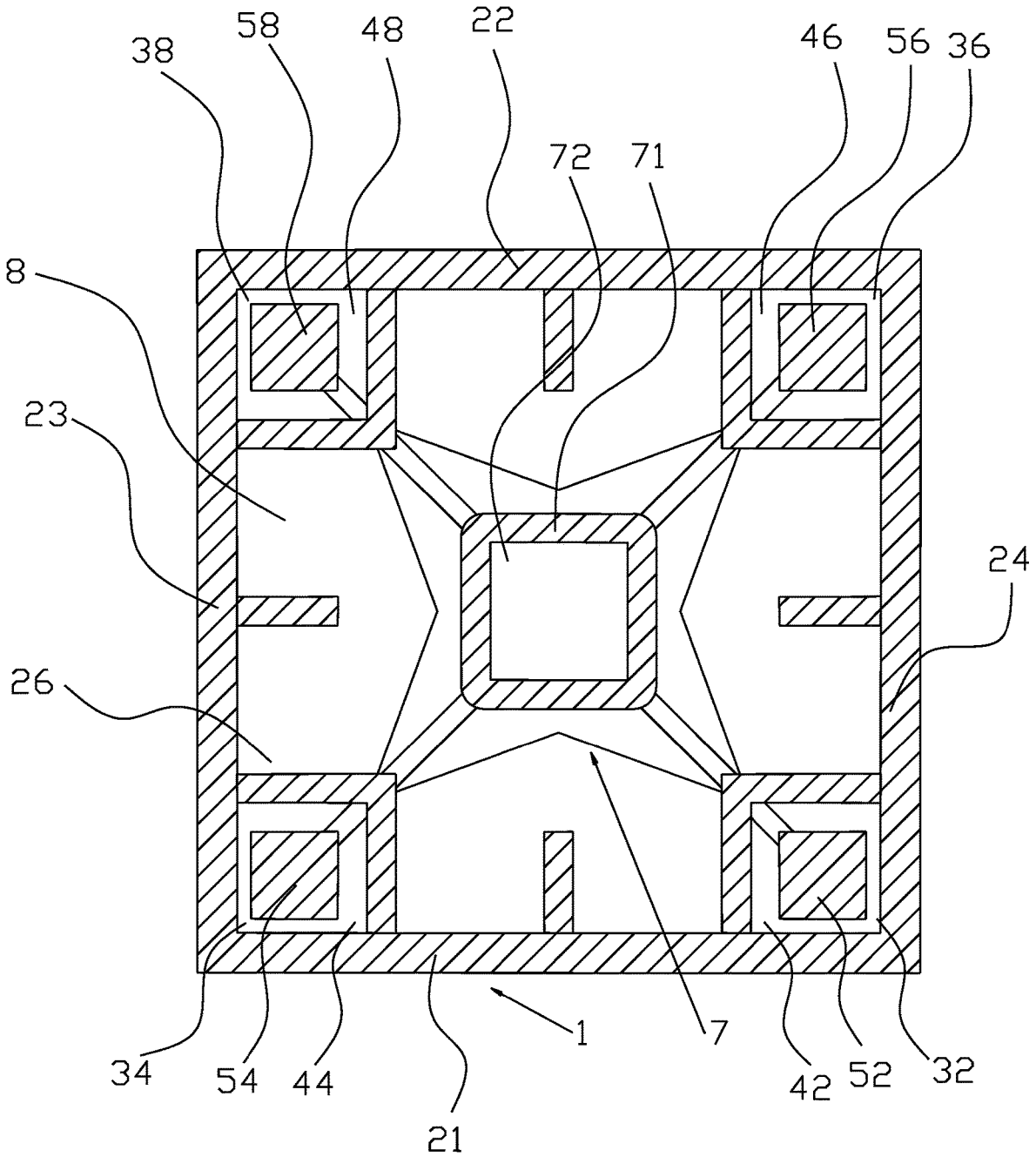
FIG. 4 is a section view cutting along a second corner unit, a fourth corner unit, a sixth corner unit and an eighth corner unit in Embodiment III.
Figure 5:
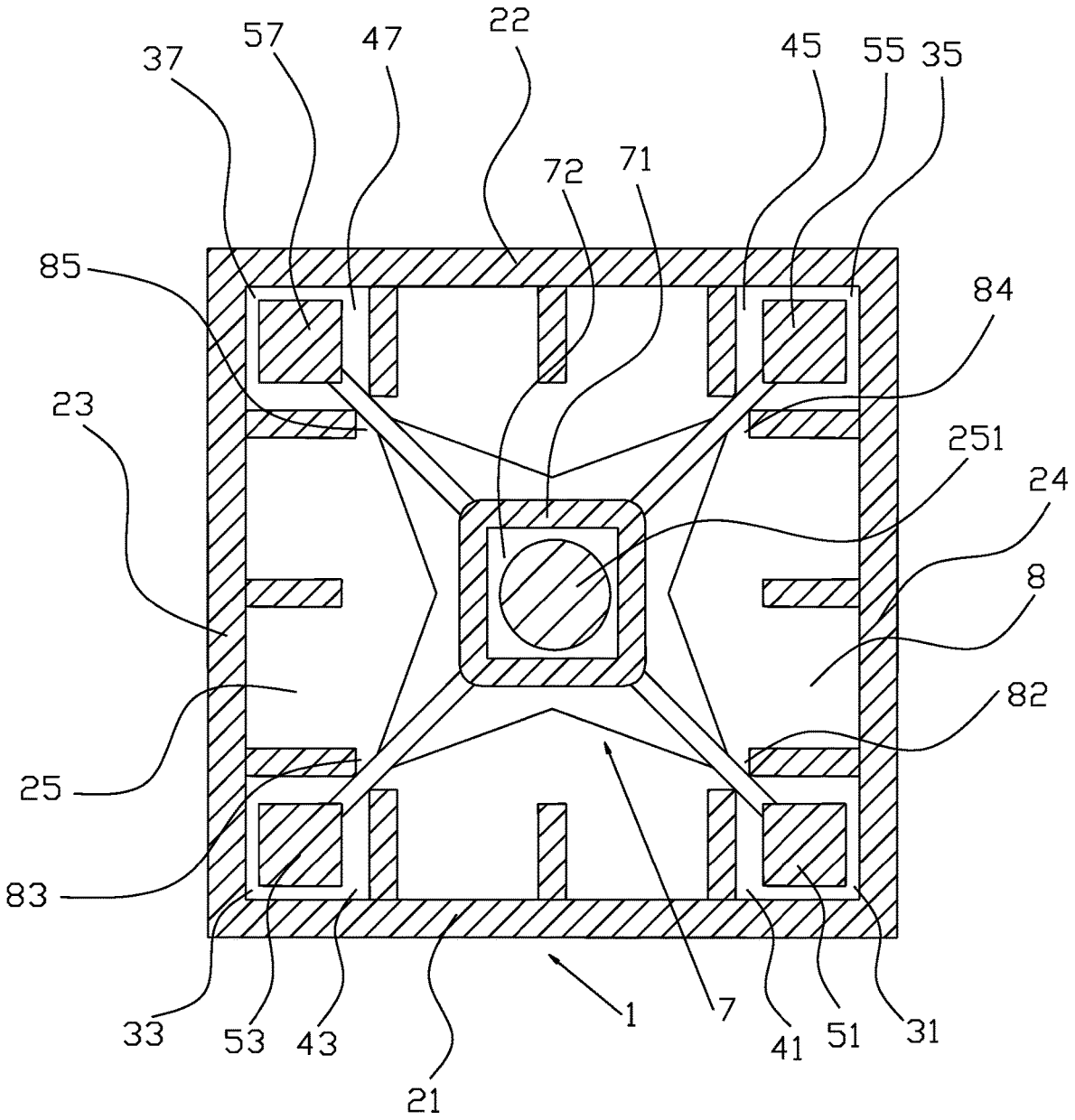
FIG. 5 is a section view cutting along a first corner unit, a third corner unit, a fifth corner unit and a seventh corner unit in Embodiment III.
Figure 6:
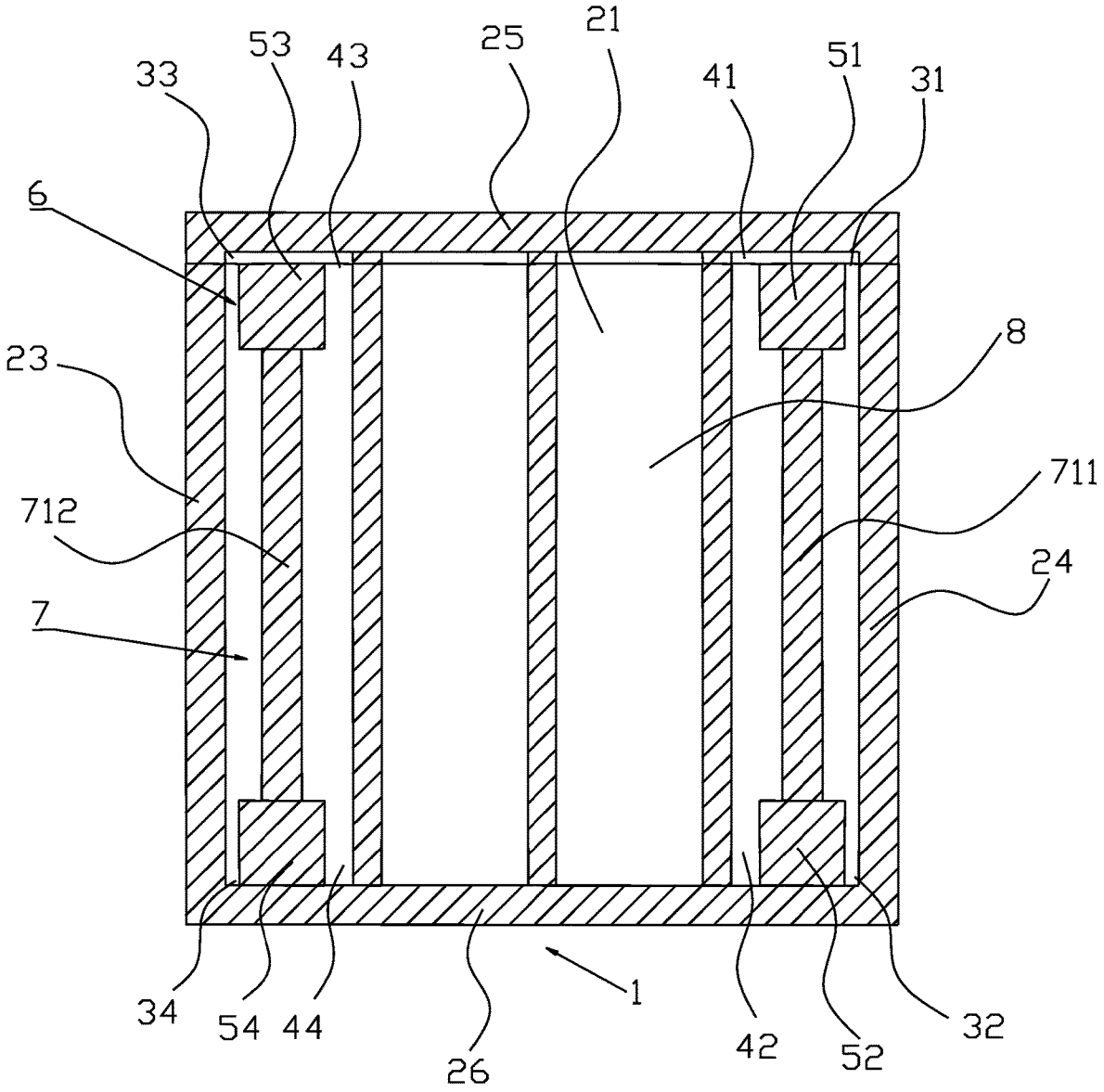
FIG. 6 is a section view cutting along a first corner unit, a second corner unit, a third corner unit and a fourth corner unit in Embodiment III.
Figure 7:
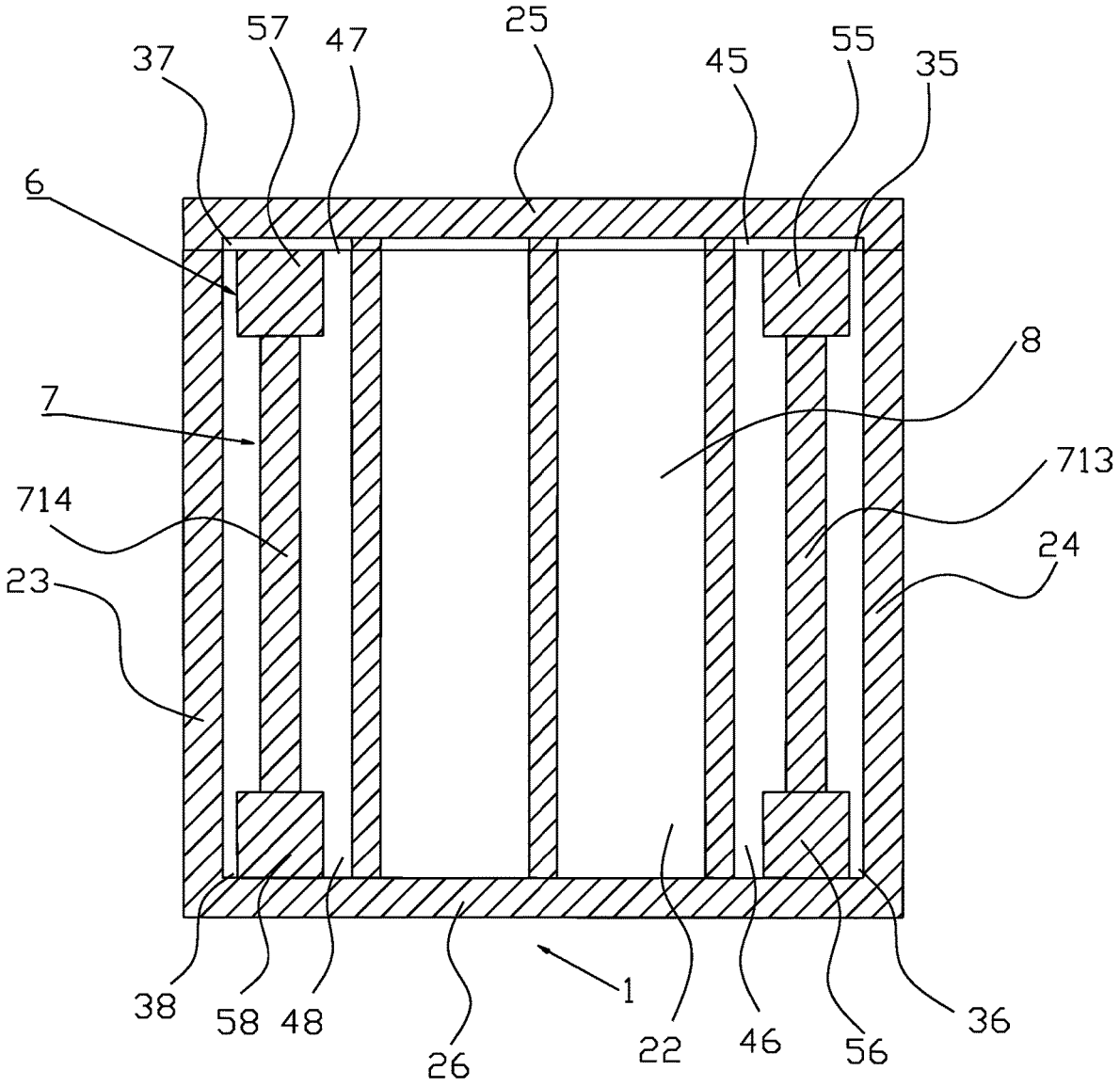
FIG. 7 is a section view cutting along a fifth corner unit, a sixth corner unit, a seventh corner unit and an eighth corner unit in Embodiment III.
Figure 8:
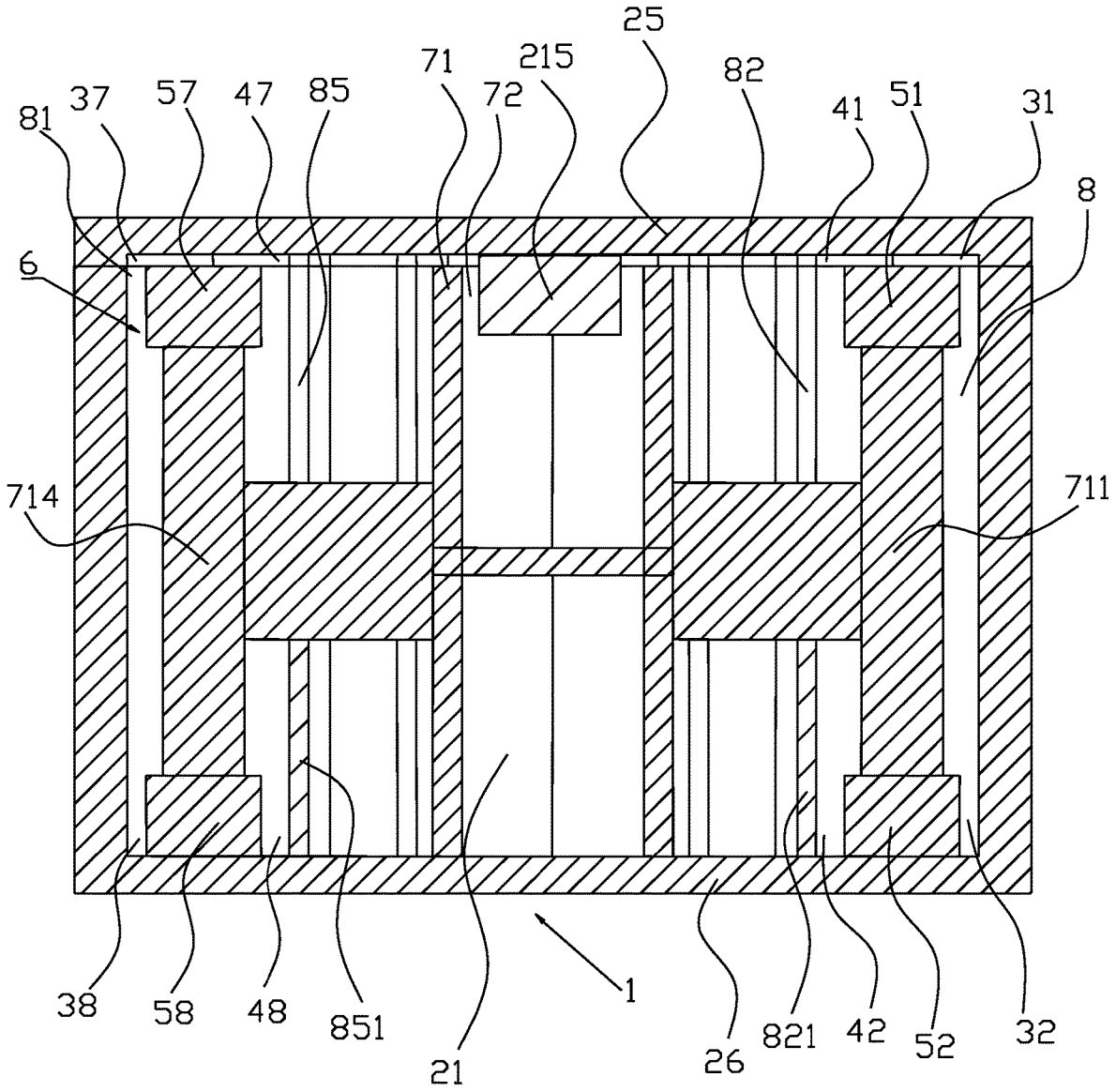
FIG. 8 is a section view cutting along a first corner unit, a second corner unit, a seventh corner unit and a seventh corner unit in Embodiment III.
Figure 9:
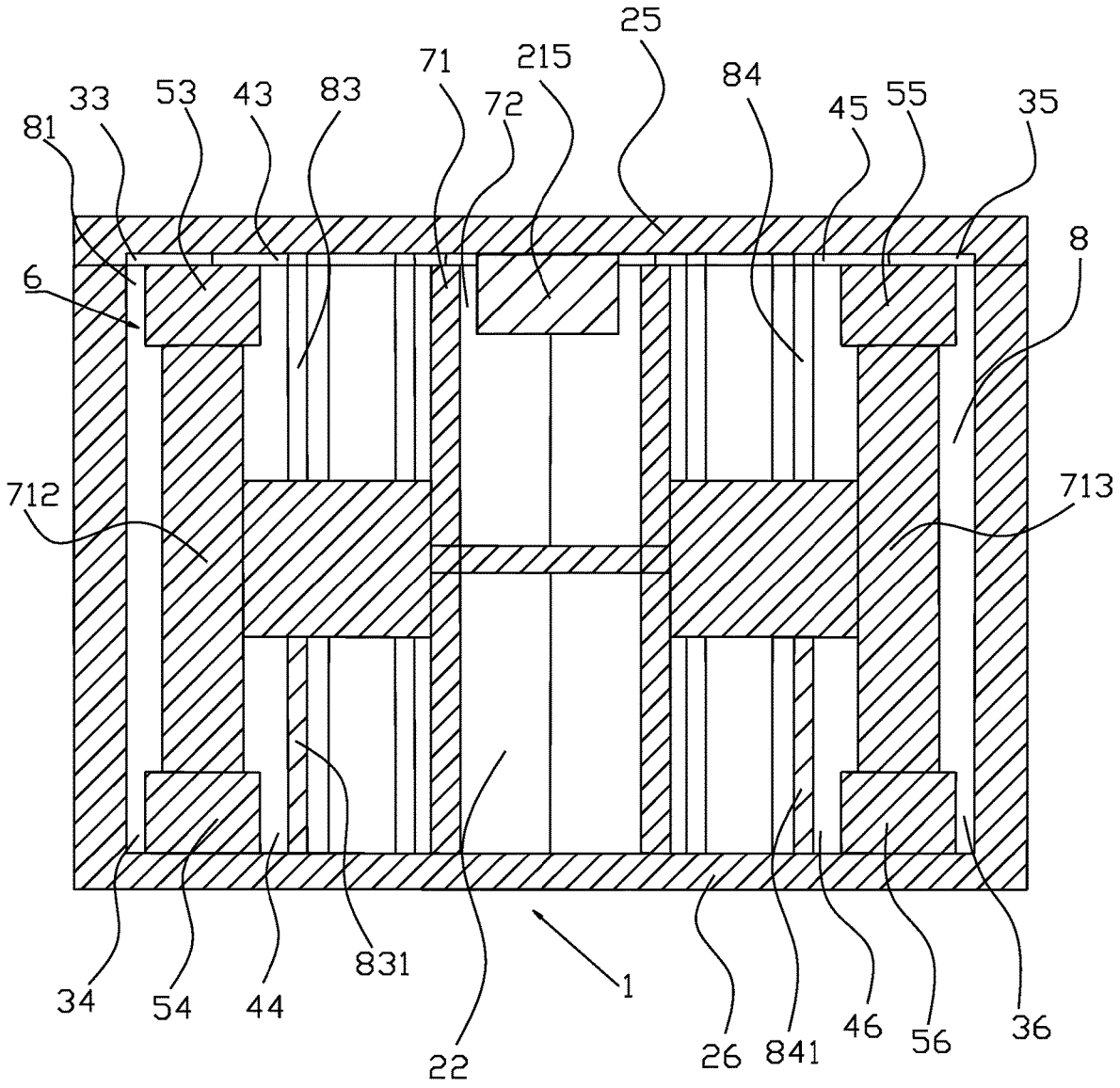
FIG. 9 is a section view cutting along a third corner unit, a fourth corner unit, a fifth corner unit and a sixth corner unit in Embodiment III.

Referring to FIG. 3, further including a connecting shaft, the first stop column, the second stop column, the third stop column and the fourth stop column are all connected to the connecting shaft, and the first stop column, the second stop column, the third stop column and the fourth stop column are uniformly arranged around a circumferential direction of the connecting shaft.

Figure 16:
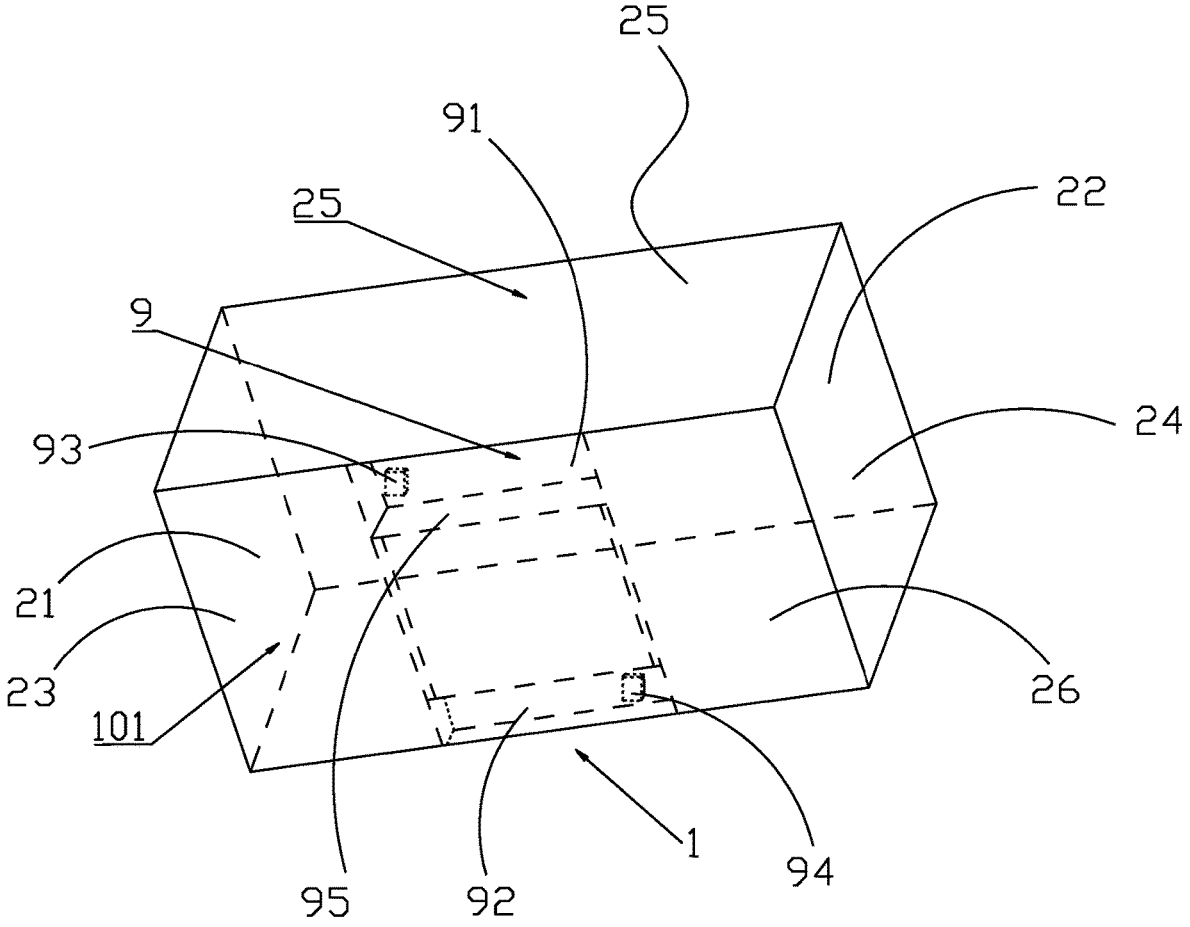
FIG. 16 is a structural schematic diagram of a second compartment, a second magnet and a second installation bracket in the present disclosure

Referring to FIG. 16, an inner wall of the building block main body 1 is also provided with a second compartment 9, and the second compartment 9 is provided with a second magnet, which can slide in the second compartment 9. The magnetic suction building block further includes a second installation bracket 95, which is disposed in the second compartment 9, so as to at least divide the second compartment 9 into a ninth compartment unit 91 and a tenth compartment unit 92; the second magnet includes a ninth magnet unit 93 and a tenth magnet unit 94, and the ninth magnet unit 93 is disposed in the ninth compartment unit 91 and can slide in the ninth compartment unit 91; and the tenth magnet unit 94 is disposed in the tenth compartment unit 92 and can slide in the tenth compartment unit 92. Specifically, a length, a width and a height of the ninth compartment unit 91 are greater than those of the ninth magnet unit 93, and a length, and a width and a height of the tenth compartment unit 92 are greater than those of the tenth magnet unit 94; and further, the length of the ninth compartment unit 91 is at least twice of that of the ninth magnet unit 93, and the length of the tenth compartment unit 92 is at least twice of that of the tenth magnet unit 94. The ninth magnet unit and the tenth magnet unit may slide to more positions through the above structure in a manner that the ninth magnet unit slides in the ninth compartment unit and the tenth magnet unit slides in the tenth compartment unit, which is convenient for users to realize the design and building of more misaligned shapes. Moreover, the hollow second installation bracket further reduces the product dead weight, and the ninth magnet unit sliding in the ninth compartment unit and the tenth magnet unit sliding in the tenth compartment unit increase the magnetism of the magnetic suction building block. It is noted that FIG. 16 only illustrates the structure of the second compartment, and does not illustrate other structures.

In this embodiment, the second compartment 9 is disposed on an inner wall of the first surrounding wall group, and extends to the upper side of the first surrounding wall group from the lower side of the first surrounding wall group, and the second installation bracket 95 is disposed in a middle of the second compartment 9, such that the second installation bracket 95 divides the second compartment 9 into the ninth compartment unit 91, located at the upper side of the first surrounding wall group, and the tenth compartment unit 92, located at the lower side of the first surrounding wall group. Where the second compartment 9 is disposed on the upper side wall, and extends to the upper side of the upper side wall from the lower side of upper side wall, and the second installation bracket 95 is disposed in a middle of the second compartment 9, such that the second installation bracket 95 divides the second compartment 9 into the ninth compartment unit 91, located at the upper side of the upper side wall, and the tenth compartment unit 92, located at the lower side of the upper side wall. Specifically, the second compartment 9 is disposed on the lower side wall, and extends to the upper side of the lower side wall group from the lower side of the lower side wall, and the second installation bracket 95 is disposed in a middle of the second compartment 9, such that the second installation bracket divides the second compartment 9 into the ninth compartment unit 91, located at the upper side of the lower side wall, and the tenth compartment unit 92, located at the lower side of the lower side wall. Further, the second compartment 9 is square, and the second installation bracket 95 is hollow square. The setting of the second compartment is effectively implemented through the above structure, which is convenient for users to realize the design and building of more misaligned shapes.

Embodiment II

Referring to FIG. 1, FIG. 2 and FIG. 10, providing a building block main body 1, where the building block main body 1 includes a first surrounding wall group, an upper side wall 25, a lower side wall 26, a first inner wall group 102, a third inner wall group 105 and a second inner wall group 104, a lower side of the first surrounding wall group 101 is connected to the lower side wall 26, and a second crossed corner part is formed at a joint between the lower side of the first surrounding wall group 101 and the lower side wall 26; the third inner wall group 105 is connected to an inner surface of the lower side wall 26, and a second compartment part is formed on inner surfaces of the third inner wall group 105 and the lower side wall 26; and the first inner wall group 102 is connected to the inner surface of the first surrounding wall group 101, the first inner wall group 102 surrounds the inner surface of the first surrounding wall group 101 to form a mounting slot group 103, and the mounting slot group 103 communicates with the second compartment part;

providing first magnets 5, each of which includes a first magnet part and a second magnet part, the second magnet part is disposed in the second compartment part and can rotate in the second compartment part, and the first magnet part and the second magnet part are provided with a N pole and a S pole, respectively;

providing a stop column assembly 10, which includes a plurality of stop columns, and the plurality of stop columns are placed in the mounting slot group 103, so that lower sides of the plurality of stop columns stop the second magnet part in the second compartment part;

the first magnet part is placed at upper sides of the plurality of stop columns, and the upper side wall 25 is connected to the upper side of the first surrounding wall group 101 through an ultrasonic hot melting mode; and the second inner wall group 104 is connected to the inner surface of the upper side wall 25, the first compartment part is formed on the inner surfaces of the second inner wall group 104 and the upper side wall 25, and the first compartment part communicates with the mounting slot group 103, so that upper sides of the plurality of stop columns stop the first magnet part in the first compartment part, and the first magnet part can rotate in the first compartment part. The upper side wall is connected to the upper side of the first surrounding wall group by the ultrasonic hot melting mode or an adhesive mode.

Through the above structure, the upper side wall is connected to the upper side of the first surrounding wall group 101, with a reasonable design, a simple structure, reliability, a stable connection, a capacity of effectively improving the production efficiency, and a lower cost.

Embodiment III

Referring to FIG. 1 and FIGS. 3 to 10, a magnetic suction building block, including a building block main body 1, which is formed by a plurality of side walls 2 in mutual connection, crossed corners 3 are formed at joints between adjacent side walls 2, first compartments 4 are disposed at the crossed corners 3, and first magnets 5 are disposed inside the first compartments 4; and the first magnets 5 may rotate in the first compartments 4, and each first magnet 5 is provided with a N pole and a S pole. Since the above structure includes a building block main body, which is formed by a plurality of side walls in mutual connection, the crossed corners are formed at the joints between adjacent side walls, the first compartments are disposed at the crossed corners, and the first magnets are disposed inside the first compartments, the magnetic suction building blocks may attract to each other through the first magnets arranged in the first compartments at the crossed corners, so that the magnetic suction building blocks may be mutually connected at the crossed corners, thereby implementing the misplaced connection among the magnetic suction building blocks and implementing the design and building of the misplaced shapes. Compared with the magnetic suction building blocks that can only be stacked on the same axis in the existing technology, the building mode and playing method of the magnetic suction building block provided by the present disclosure are greatly enriched, so as to help children build more shapes, and various pattern combinations may be built in combination with surface patterns of the magnetic suction building blocks, so as to greatly improve the children's interest in modeling and help develop the children's imagination. Further, since the first magnets may rotate in the first compartments and are provided with the N pole and the S pole in respective, when the magnetic suction building blocks are mutually stacked at the crossed corners, the first magnets of the magnetic suction building block may easily guide the N pole of the magnetic suction building block to be tightly absorbed with the S pole of another same magnetic suction building block by rotating, or guide the S pole of the magnetic suction building block to be tightly absorbed with the N pole of another same magnetic suction building block by rotating, so as to implement a stable connection among the magnetic suction building blocks, implement a misplaced connection among the magnetic suction building blocks, and implement the design and building of the misplaced shapes.

In this embodiment, the building block main body 1 is a square building block main body, the building block main body 1 is provided with six side walls 2, which are a front side wall 21, a rear side wall 22, a left side wall 23, a right side wall 24, an upper side wall 25 and a lower side wall 26; a right side of the front side wall 21 is connected to the right side wall 24, upper sides of the front side wall 21 and the right side wall 24 are both connected to the upper side wall 25, and lower sides of the front side wall 21 and the right side wall 24 are both connected to the lower side wall 26; a left side of the front side wall 21 is connected to the left side wall 23, upper sides of the front side wall 21 and the left side wall 23 are both connected to the upper side wall 25, and lower sides of the front side wall 21 and the left side wall 23 are both connected to the lower side wall 26; a left side of the rear side wall 22 is connected to the right side wall 24, upper sides of the rear side wall 22 and the right side wall 24 are both connected to the upper side wall 25, and lower sides of the rear side wall 22 and the right side wall 24 are both connected to the lower side wall 26; and a right side of the rear side wall 22 is connected to the left side wall 23, upper sides of the rear side wall 22 and the left side wall 23 are both connected to the upper side wall 25, and lower sides of the rear side wall 22 and the left side wall 23 are both connected to the lower side wall 26. The crossed corner 3 includes a first crossed corner unit 31 disposed at a joint among the front side wall 21, the right side wall 24 and the upper side wall 25, a second crossed corner unit 32 disposed at a joint among the front side wall 21, the right side wall 24 and the lower side wall 26, a third crossed corner unit 33 disposed at a joint among the front side wall 21, the left side wall 23 and the upper side wall 25, a fourth crossed corner unit 34 disposed at a joint among the front side wall 21, the left side wall 23 and the lower side wall 26, a fifth crossed corner unit 35 disposed at a joint among the rear side wall 22, the right side wall 24 and the upper side wall 25, a sixth crossed corner unit 36 disposed at a joint among the rear side wall 22, the right side wall 24 and the lower side wall 26, a seventh crossed corner unit 37 disposed at a joint among the rear side wall 22, the left side wall 23 and the upper side wall 25, and an eighth crossed corner unit 38 disposed at a joint among the rear side wall 22, the left side wall 23 and the lower side wall 26. Specifically, the first compartment 4 includes a first compartment unit 41 disposed at the first crossed corner unit 31, a second compartment unit 42 disposed at the second crossed corner unit 32, a third compartment unit 43 disposed at the third crossed corner unit 33, a fourth compartment unit 44 disposed at the fourth crossed corner unit 34, a fifth compartment unit 45 disposed at the fifth crossed corner unit 35, a sixth compartment unit 46 disposed at the sixth crossed corner unit 36, a seventh compartment unit 47 disposed at the seventh crossed corner unit 37, and an eighth compartment unit 48 disposed at the eighth crossed corner unit 38. Further, the first magnet 5 includes a first magnet unit 51 disposed at the first compartment unit 41, a second magnet unit 52 disposed at the second compartment unit 42, a third magnet unit 53 disposed at the third compartment unit 43, a fourth magnet unit 54 disposed at the fourth compartment unit 44, a fifth magnet unit 55 disposed at the fifth compartment unit 45, a sixth magnet unit 56 disposed at the sixth compartment unit 46, a seventh magnet unit 57 disposed at the seventh compartment unit 47, and an eighth magnet unit 58 disposed at the eighth compartment unit 48. Through the above structure with a reasonable design, a simple structure and a stable connection and by setting the first magnets in the first corner unit, the second corner unit, the third corner unit, the fourth corner unit, the fifth corner unit, the sixth corner unit, the seventh corner unit and the eighth corner unit of the square building block, various magnetic suction building blocks may be mutually misplaced, connected and stacked at the corner of each side wall, so as to implement the design and building of the misplaced shapes.

In this embodiment, the first compartment 4 is provided with an installation opening 6, and the first magnet 5 is placed in the first compartment 4 through the installation opening 6; the magnetic suction building block further includes a first installation bracket 7, an accommodating cavity 8 is formed among the left side wall 23, the right side wall 24, the front side wall 21, the rear side wall 22 and the lower side wall 26, the accommodating cavity 8 is provided with an accommodating opening 81, and when the first installation bracket 7 is placed in the accommodating cavity 8 through the accommodating opening 81, the upper side wall 25 covers the accommodating opening 81, so that the first installation bracket 7 stops the first magnet 5 in the first compartment 4. The first installation bracket 7 includes a connecting shaft 71, a locating shaft hole 72 is formed in the connecting shaft 71, the upper side wall 25 is provided with a locating shaft 251, and when the upper side wall 25 covers the accommodating opening 81, the locating shaft 251 is sleeved on the locating shaft hole 72. Specifically, the connecting shaft 71 is provided with a first stop column 711, a second stop column 712, a third stop column 713 and a fourth stop column 714, and the first stop column 711, the second stop column 712, the third stop column 713 and the fourth stop column 714 are arranged uniformly along a circumferential direction of the connecting shaft 71; an upper side of the first stop column 711 stops the first magnet unit 51 in the first compartment unit 41, and a lower side of the first stop column 711 stops the second magnet unit 52 in the second compartment unit 42; an upper side of the second stop column 712 stops the third magnet unit 53 in the third compartment unit 43, and a lower side of second stop column 712 stops the fourth magnet unit 54 in the fourth compartment unit 44; an upper side of the third stop column 713 stops the fifth magnet unit 55 in the fifth compartment unit 45, and a lower side of the third stop column 713 stops the sixth magnet unit 56 in the sixth compartment unit 46; and an upper side of the fourth stop column 714 stops the seventh magnet unit 57 in the seventh compartment unit 47, and a lower side of the fourth stop column 714 stops the eighth magnet unit 58 in the eighth compartment unit 48. Through the above structure, a structure for setting the first magnets in the first corner unit, the second corner unit, the third corner unit, the fourth corner unit, the fifth corner unit, the sixth corner unit, the seventh corner unit and the eighth corner unit is effectively implemented; and the first magnet is stopped in the first compartment through the first installation bracket, so that the position of the first magnet may be fixed in the first compartment, thereby ensuring the connecting stability among the magnetic suction building blocks.

In this embodiment, a first slot 82, a second slot 83, a third slot 84 and a fourth slot 85 are also arranged inside the accommodating cavity 8, a first stop side 821 is disposed on the first slot 82, the first stop side 821 is used to stop the first stop column 711, so that a distance between a lower side of the first stop column 711 and the lower side wall 26 is fixed, and the second magnet unit 52 can rotate in the second compartment unit 42; a second stop side 831 is disposed on the second slot 83, the second stop side 831 is used to stop the second stop column 712, so that a distance between a lower side of the second stop column 712 and the lower side wall 26 is fixed, and the fourth magnet unit 54 can rotate in the fourth compartment unit 44; a third stop side 841 is disposed on the third slot 84, the third stop side 841 is used to stop the third stop column 713, so that a distance between a lower side of the third stop column 713 and the lower side wall 26 is fixed, and the sixth magnet unit 56 can rotate in the sixth compartment unit 46; and a fourth stop side 851 is disposed on the fourth slot 85, the fourth stop side 851 is used to stop the fourth stop column 714, so that a distance between a lower side of the fourth stop column 714 and the lower side wall 26 is fixed, and the eighth magnet unit 58 can rotate in the eighth compartment unit 48. A horizontal width of the first magnet is less than that of the first compartment, a horizontal length of the first magnet is less than that of the first compartment, and a longitudinal height of the first magnet is less than that of the first compartment. Through the above structure with a reasonable design, a simple structure and a stable connection and by setting the first stop side, the second stop side, the third stop side and the fourth stop side, the installation position of the first installation bracket may be fixed, which is not only convenient for a user to install the first installation bracket, but also ensures that the accommodating space of the first compartment is not compressed by the first installation bracket, thereby ensuring that the first magnet may rotate in the compartment.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A magnetic suction building block, comprising:

a building block main body, wherein the building block main body is a square building block main body and formed by six side walls in mutual connection;

wherein the six side walls comprises a front side wall, a rear side wall, a left side wall, a right side wall, an upper side wall and a lower side wall;

wherein the building block main body further comprises four internal wall groups corresponding to four joints formed by the front side wall, the rear side wall, the left side wall and the right side wall respectively;

wherein each internal wall group is located at a corresponding joint formed by two corresponding adjacent side walls respectively and comprises two internal walls connected with the two corresponding adjacent side walls respectively;

wherein four compartments are defined by the four internal wall groups, the front side wall, the rear side wall, the left side wall and the right side wall, each compartment is defined by the two internal walls of a corresponding internal wall group and the two corresponding adjacent side walls;

wherein the building block main body further comprises four supporting poles corresponding to the four compartments, each supporting pole is located at a corresponding compartment;

wherein the building block main body further comprises four groups of magnet units, each group of magnet units is received in a corresponding compartment, each group of magnet units comprises two magnet units at two opposite ends of a corresponding support pole;

wherein each magnet unit is capable of rotating in a corresponding compartment, and each magnet unit is provided with an N pole and an S pole;

wherein each internal wall group extends from the lower side wall to the upper side wall, each supporting pole and two corresponding magnet units at two opposite ends of each supporting pole are received in a corresponding compartment.

2. The magnetic suction building block according to claim 1, wherein each supporting pole is rod-shaped, and an extending direction of the compartment is identical with that of the supporting pole.

3. The magnetic suction building block according to claim 2, wherein each supporting pole is circular in cross-section.

4. The magnetic suction building block according to claim 1, wherein two opposite ends of each supporting pole are in direct contact with the two corresponding magnet units.

5. The magnetic suction building block according to claim 1, further comprising a gap formed between the upper side wall and one of the two magnet units.

6. The magnetic suction building block according to claim 1, wherein the building block main body is made of light-transmitting material.

7. A magnetic suction building block, comprising:

a building block main body, wherein the building block main body is a square building block main body and formed by six side walls in mutual connection;

wherein the six side walls comprises a front side wall, a rear side wall, a left side wall, a right side wall, an upper side wall and a lower side wall;

wherein the building block main body further comprises four internal wall groups corresponding to four joints formed by the front side wall, the rear side wall, the left side wall and the right side wall respectively;

wherein each internal wall group is located at a corresponding joint formed by two corresponding adjacent side walls respectively and comprises two internal walls connected with the two corresponding adjacent side walls respectively;

wherein four compartments are defined by the four internal wall groups, the front side wall, the rear side wall, the left side wall and the right side wall, each compartment is defined by the two internal walls of a corresponding internal wall group and the two corresponding adjacent side walls;

wherein the building block main body further comprises four supporting poles corresponding to the four compartments, each supporting pole is located at a corresponding compartment;

wherein the building block main body further comprises four groups of magnet units, each group of magnet units is received in a corresponding compartment, each group of magnet units comprises two magnet units at two opposite ends of a corresponding support pole;

wherein each magnet unit is capable of rotating in a corresponding compartment, and each magnet unit is provided with an N pole and an S pole;

wherein the supporting poles are rod-shaped, and an extending direction of the compartments is identical with that of the supporting poles;

wherein each of the supporting poles is capable of moving upwards and downwards along the extending direction thereof.

8. The magnetic suction building block according to claim 7, wherein each supporting pole is circular in cross-section.

9. The magnetic suction building block according to claim 7, wherein two opposite ends of each supporting pole are in direct contact with the two corresponding magnet units.

10. The magnetic suction building block according to claim 7, further comprising a gap formed between the upper side wall and one of the two magnet units.

11. The magnetic suction building block according to claim 7, wherein the building block main body is made of light-transmitting material.

* * * * *